US010907423B2

(12) United States Patent
Ferrari

(10) Patent No.: US 10,907,423 B2
(45) Date of Patent: Feb. 2, 2021

(54) MANIPULATOR APPARATUS FOR HANDLING OF PERFORATION ELEMENTS TO AND FROM A DRILLING FLOOR

(71) Applicant: DRILLMEC S.p.A., Gariga di Podenzano (IT)

(72) Inventor: Stefano Ferrari, Barbiano (IT)

(73) Assignee: DRILLMEC S.p.A., Gariga di Podenzano (IT)

( * ) Notice: Subject to any disclaimer, the term of this patent is extended or adjusted under 35 U.S.C. 154(b) by 0 days.

(21) Appl. No.: 15/855,759

(22) Filed: Dec. 27, 2017

(65) Prior Publication Data

US 2018/0179836 A1 Jun. 28, 2018

(30) Foreign Application Priority Data

Dec. 27, 2016 (EP) ..... 16425118

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/15; E21B 19/14; F15B 15/1428; F15B 15/1471
See application file for complete search history.

(56) References Cited

U.S. PATENT DOCUMENTS 2,576,908 A * 11/1951 Wallace ..... B66F 7/0641 187/211
4,235,566 A 11/1980 Beeman et al.
4,386,883 A 6/1983 Hogan et al.
4,403,898 A * 9/1983 Thompson ..... E21B 19/155 175/85
4,544,322 A * 10/1985 Booker ..... B63H 23/34 114/65 R
5,305,683 A * 4/1994 Gosdowski ..... B23Q 1/58 92/128

(Continued)

FOREIGN PATENT DOCUMENTS

CA 2224638 A1 * 6/1999 ..... E21B 19/14
CA 2897654 A1 * 1/2016 ..... E21B 19/155

(Continued)

OTHER PUBLICATIONS

European Search Report from European Patent Application No. 16425118.3, dated Jul. 5, 2017.

*Primary Examiner* — Gregory W Adams
(74) *Attorney, Agent, or Firm* — Merchant & Gould P.C.

(57) ABSTRACT

A handling apparatus moves drilling elements from and to a drill floor of a drilling rig includes a main support structure having a first end and a second end. An extendable ramp is between the first end of the main support structure and the drill floor. A carrier is movable relative to the main support structure and includes a first end close to the ramp and a second end distant from said ramp. A lift arm lifts and positions the carrier and includes a first end and a second end. The carrier moves between: a first position, in which the carrier is arranged above the main support structure; and a second position, in which the carrier is lifted at the level of the drill floor. The lift arm is under the carrier to move and support the second end of the carrier from and to the second position.

12 Claims, 17 Drawing Sheets

(56) References Cited

U.S. PATENT DOCUMENTS 5,511,461 A * 4/1996 Miyachi ..... B23Q 1/58 92/13.5
5,615,598 A * 4/1997 Noroy ..... F15B 15/1428 92/117 A
7,163,367 B2 * 1/2007 Handley ..... E21B 19/155 405/166
7,404,697 B2 * 7/2008 Thompson ..... E21B 19/155 414/22.58
7,635,249 B2 * 12/2009 Guidroz ..... E21B 19/14 414/22.52
7,665,944 B2 * 2/2010 Guidroz ..... E21B 19/14 187/211
7,832,974 B2 * 11/2010 Fikowski ..... E21B 19/155 414/22.54
8,215,887 B2 * 7/2012 Fikowski ..... E21B 19/155 414/22.58
8,950,996 B2 * 2/2015 Hilton ..... E21B 19/155 414/22.55
8,998,551 B2 * 4/2015 Guillory, Jr. ..... E21B 19/155 384/42
9,080,397 B2 * 7/2015 Ludwig ..... E21B 19/155
2011/0044787 A1 2/2011 Fikowski et al.
2013/0251491 A1 * 9/2013 Ludwig ..... E21B 19/14 414/745.8
2014/0151021 A1 * 6/2014 Yorga ..... E21B 19/15 166/77.51
2014/0286732 A1 * 9/2014 Swanson ..... E21B 19/15 414/22.61
2016/0017674 A1 * 1/2016 Richardson ..... E21B 19/155 175/24

FOREIGN PATENT DOCUMENTS

CN 201310309 Y * 9/2009 ..... E21B 19/15
CN 102926685 A * 2/2013 ..... E21B 19/15
CN 103790525 A * 5/2014 ..... E21B 19/15
CN 104358533 A * 2/2015 ..... E21B 19/15
CN 105201427 A * 12/2015 ..... E21B 19/15
CN 104265207 B 7/2016

* cited by examiner

MANIPULATOR APPARATUS FOR HANDLING OF PERFORATION ELEMENTS TO AND FROM A DRILLING FLOOR

The invention relates to a handling apparatus for moving drilling elements from a ground level towards a drill floor and from the drill floor to the ground level. The handling apparatus is adapted to position drilling elements, such as drill pipes and/or casings, in the area of the drill floor and to move the drilling elements from the drill floor towards the ground level. Said handling apparatus is known, in the drilling field, as "catwalk".

The invention takes advantage of an innovative moving system for the handling apparatus used to move drilling elements, such as drilling pipes, from and to the drill floor.

American patent application US2011044787 A1 discloses a pipe-handling apparatus, which is designed to move drilling pipes from and to the drill floor of a drilling rig including a ramp extendable between a main support structure and the drill floor. The apparatus comprises a pipe carrier for the drilling pipes, which is mounted on the main support structure in a rotary manner and is configured to move between a lower and an elevated position over the ramp. The apparatus comprises a lift arm including a first end and a second end and being pivotally connected at its first end adjacent the far end of the carrier and operable below the carrier to lift and support the carrier's far end to an elevated position. Said apparatus comprises, furthermore, a track on the main support structure for supporting the carrier and the lift arm. The apparatus comprises a drive system that pivots or moves the lift arm up about a track stop to lift the far end of the carrier and moves the near end up and over the ramp.

Said drive system is a winch and cable system, which is capable of pulling the carrier towards the drill floor.

This embodiment turns out not to be very safe, as it uses a plurality of cables and pulleys applied to a winch, and operates in areas where the operators working on the drill floor usually stand. As the carrier is moved using cables and pulleys, a safe operation can be ensured only with a constant and expensive maintenance of the moving parts. As a matter of fact, a periodic maintenance is needed, which can slow down drilling operations. Furthermore, these systems, in order to be certified as safe devices in compliance with the rules currently enforced, which are becoming stricter and stricter, require the use of further safety systems, which make the operation of the apparatus more complicated and increase the costs thereof, without mentioning the complexity of its constant maintenance.

Patent application CN104265207 also discloses a handling apparatus for drilling pipes. The apparatus comprises a ramp, a main support structure, a rotary lift arm and a V-shaped pipe carrier. The apparatus comprises a lift arm. Said lift arm, as a whole, is capable of sliding along a guide comprised in the main support structure. When it reaches the limit stop along said guide, the lift arm lifts the carrier.

This solution has proven to be especially disadvantageous, as the entire lift arm must be moved along the main element, thus complicating the distribution of the supplying conduits in the structure of the arm, which must be capable of lifting the carrier.

The object of the invention is to solve the aforesaid technical problems by providing a handling apparatus, which is adapted to move drilling elements, such as drilling pipes and/or coating elements for the drilling well, from and to a drill floor of a drilling rig using an innovative lifting system.

One aspect of the invention is relates to a handling apparatus having the features set forth in appended claim 1.

A further aspect of the invention relates to a method for lifting a drilling element from a ground level to a drill floor with the features set forth in appended claim 11.

A further aspect of the invention relates to a method for lowering a drilling element from a drill floor to a ground level with the features set forth in appended claim 13.

A further aspect of the invention relates to a drilling rig having the features set forth in appended claim 15.

The features and advantages of the apparatus, the methods and the drilling rig will be best understood upon perusal of the following detailed description of a possible embodiment of the handling apparatus and of the drilling rig with reference to the accompanying drawings, which respectively show what follows:

FIGS. 1A and 1B show respective axonometric views; FIG. 1A shows the drilling rig comprising the handling apparatus, whereas FIG. 1B shows the handling apparatus according to the invention;

FIGS. 2A-2C show the handling apparatus in different views; in particular, FIG. 2A shows the apparatus in a side view; FIG. 2B shows the apparatus in a front view; FIG. 2C shows the apparatus in a plan view from above;

FIG. 3A shows the sole main support structure of the apparatus according to the invention, FIG. 3B shows the sole carrier of the apparatus according to the invention; FIG. 3C shows the lift arm of the apparatus according to the invention;

FIG. 4A shows the lift arm in a plan sectional view from above, in a compact configuration; whereas FIG. 4B shows a detail of the lift arm, in an operating configuration of the hydraulic piston connected to the carrier;

Figure 5B:
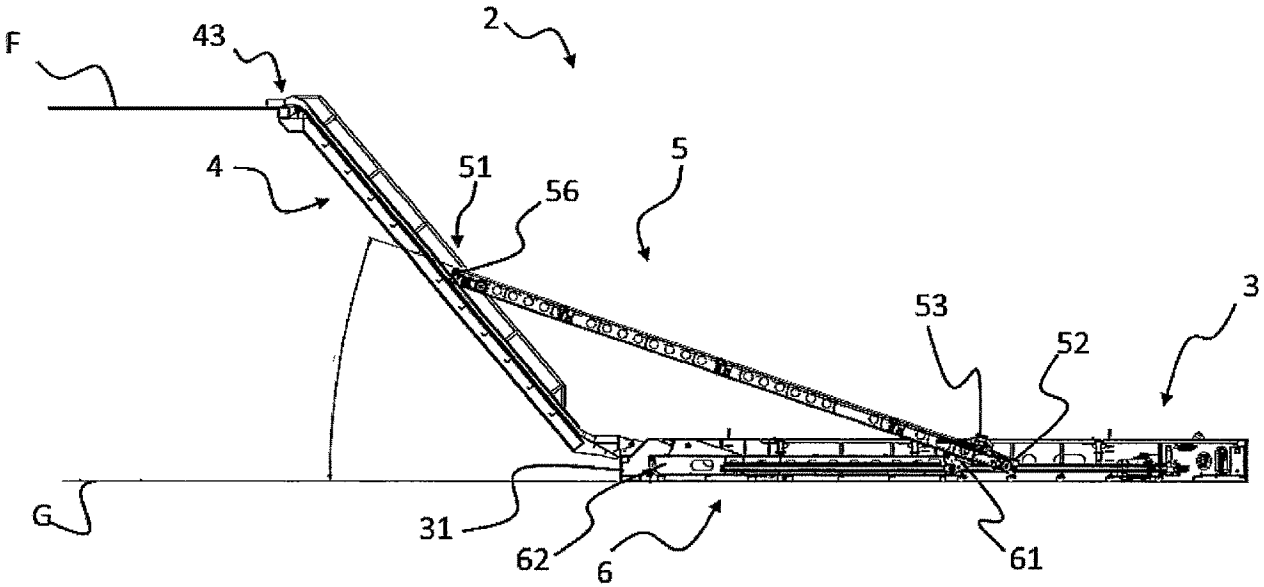
Figure 5A:
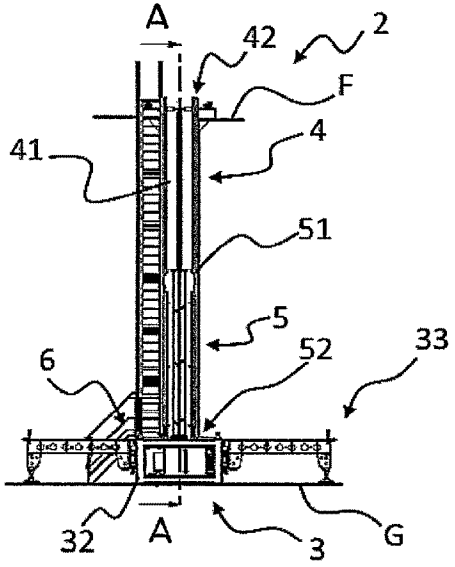
Figure 5D:
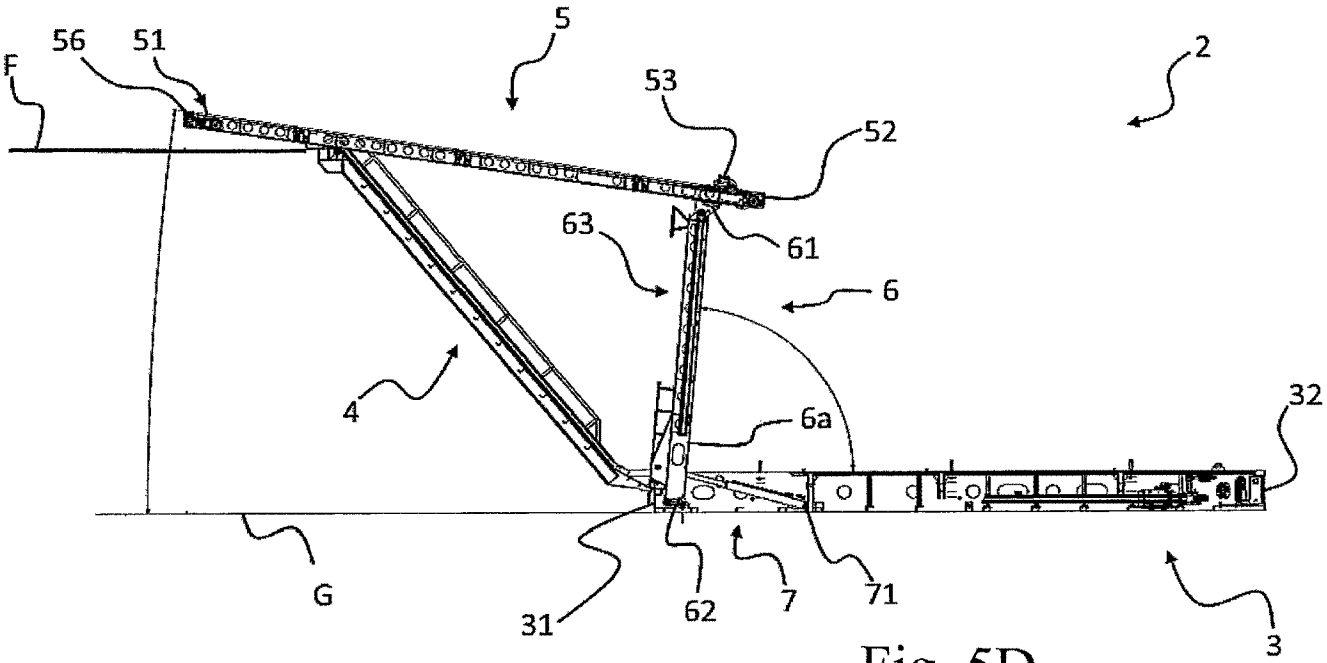
Figure 5C:
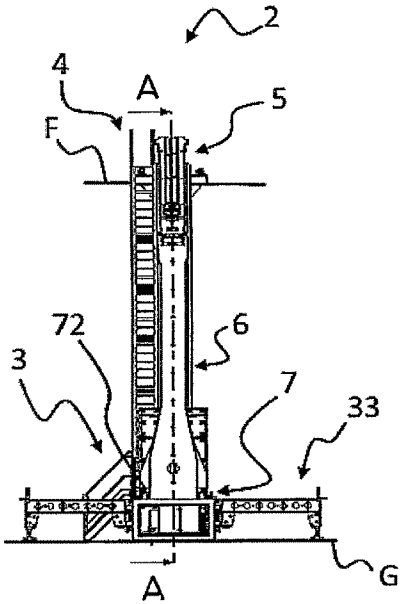
Figure 6A:
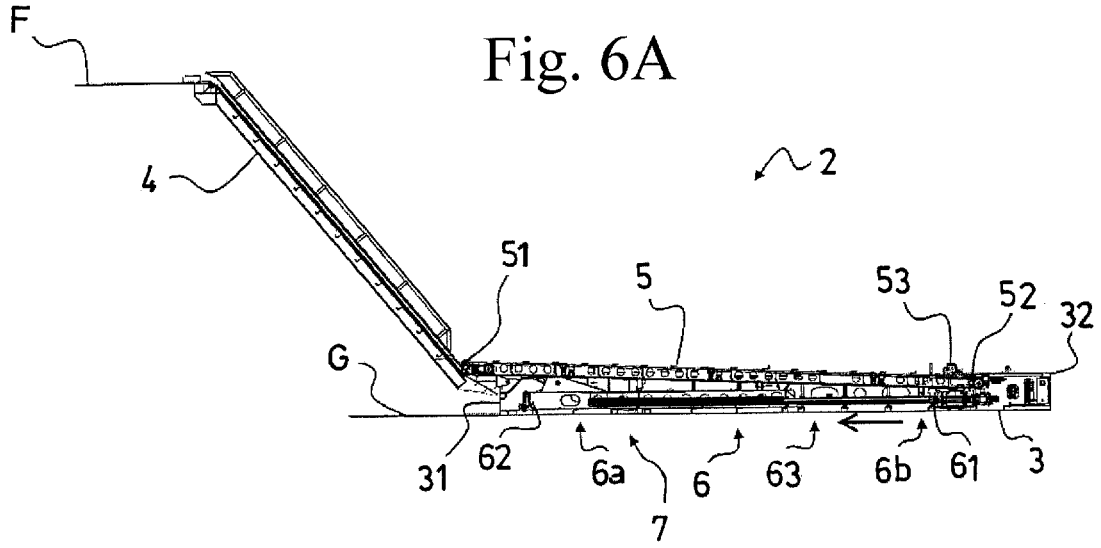
Figure 6B:
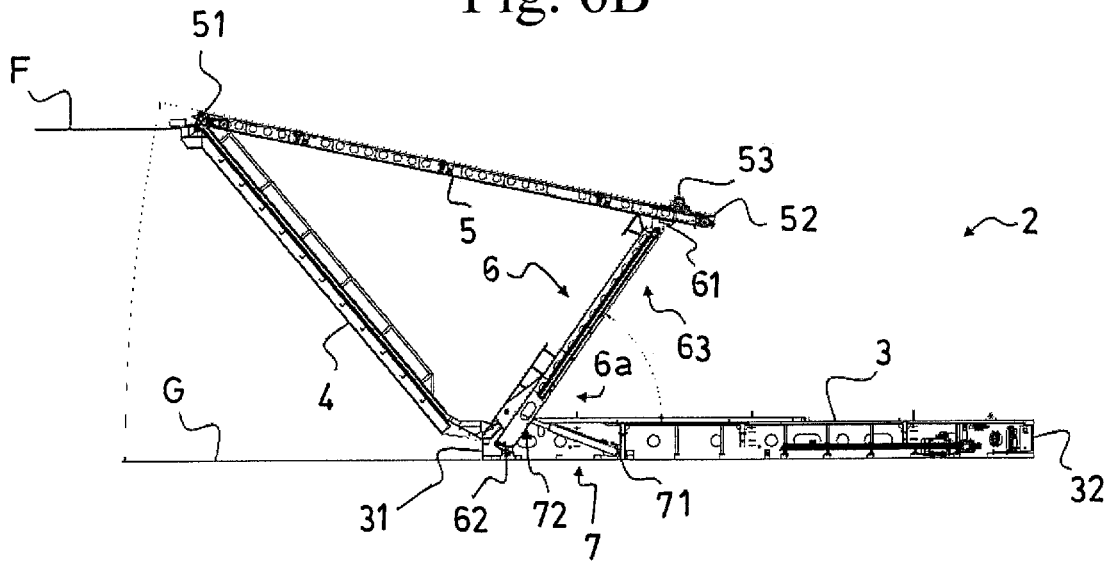
Figure 6C:
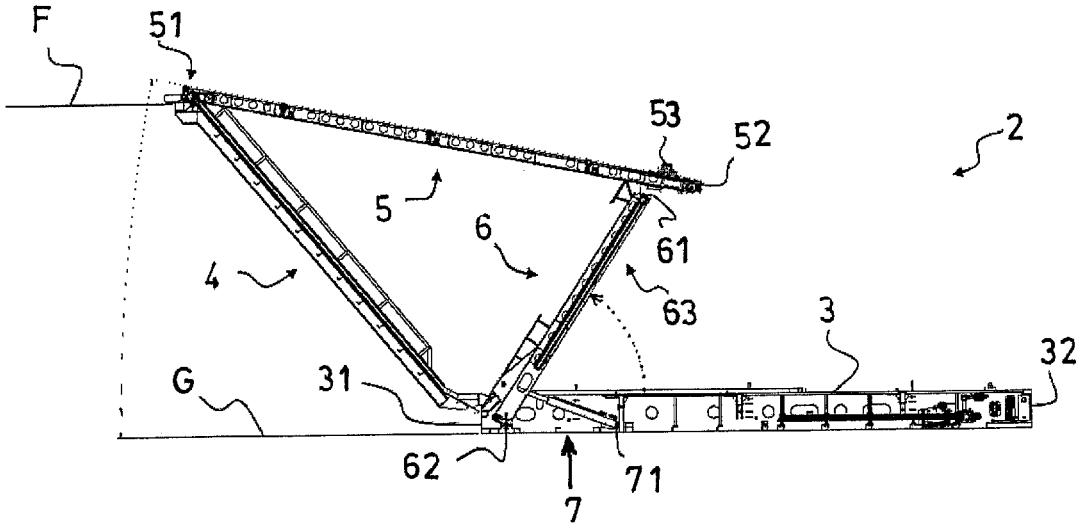
Figure 6D:
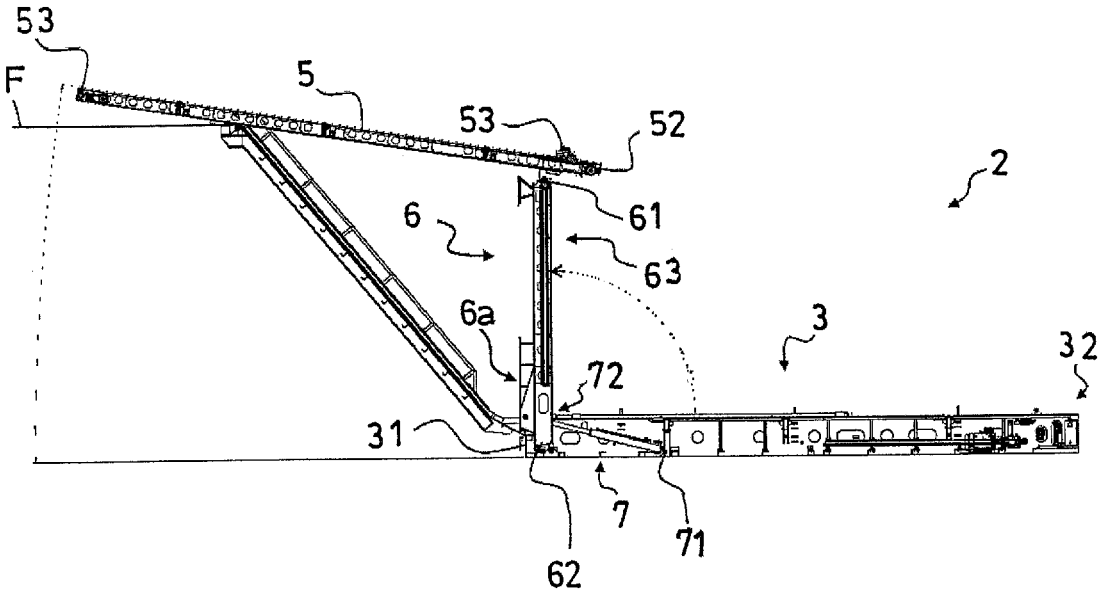
Figure 7A:
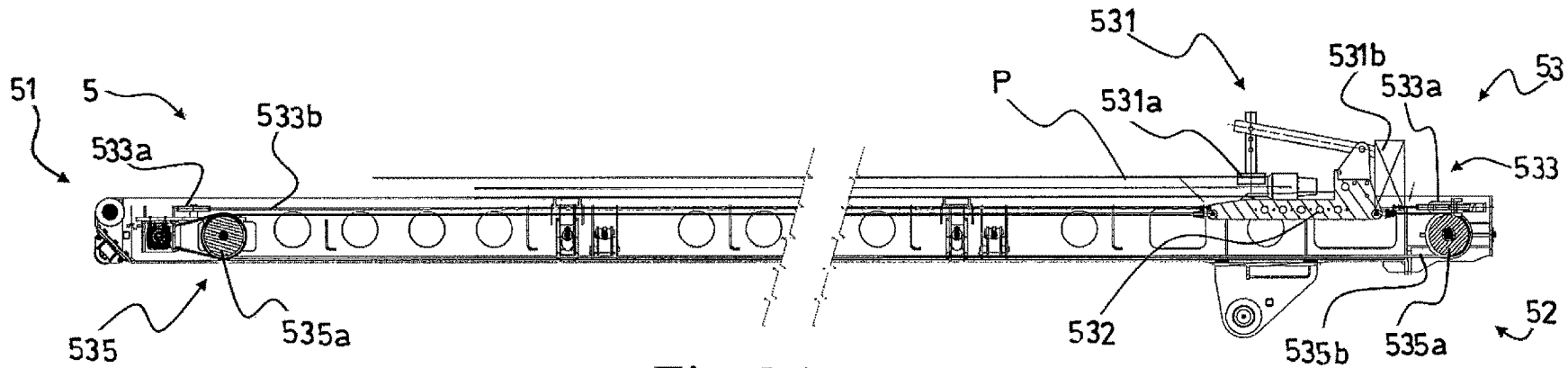
Figure 7B:
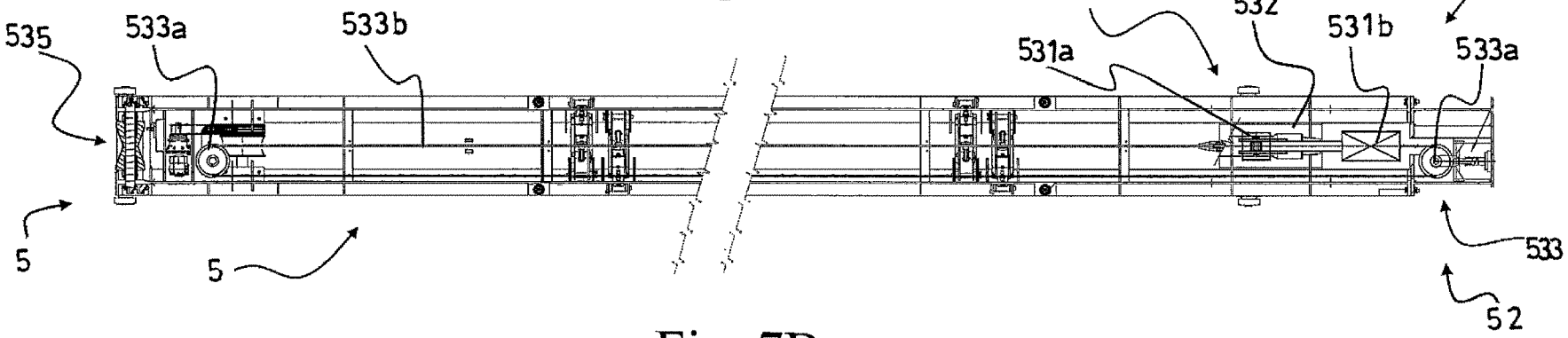
Figure 8A:
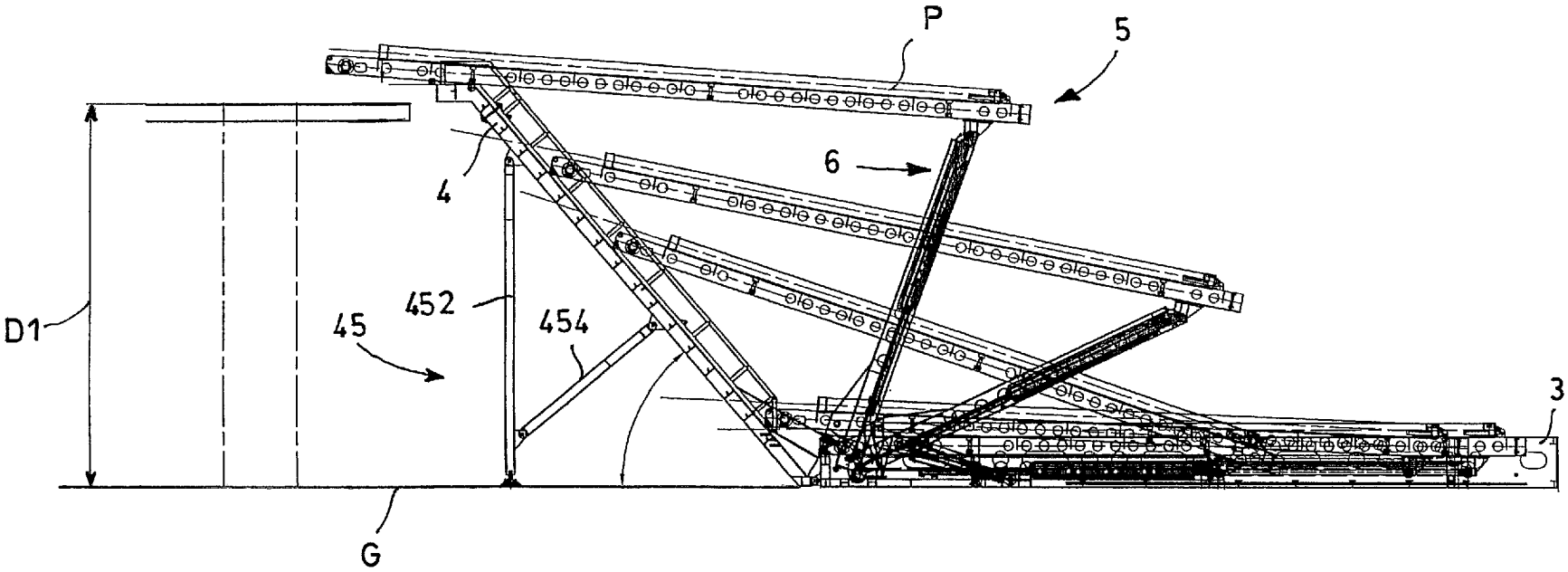
Figure 8B:
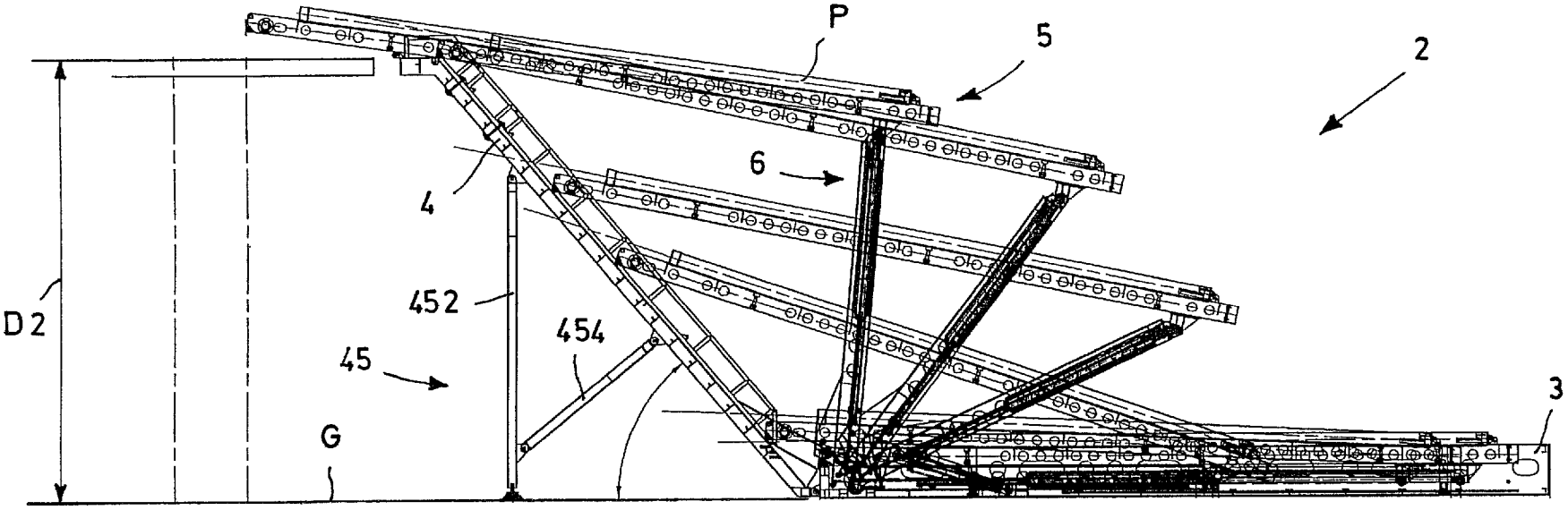
Figure 8C:
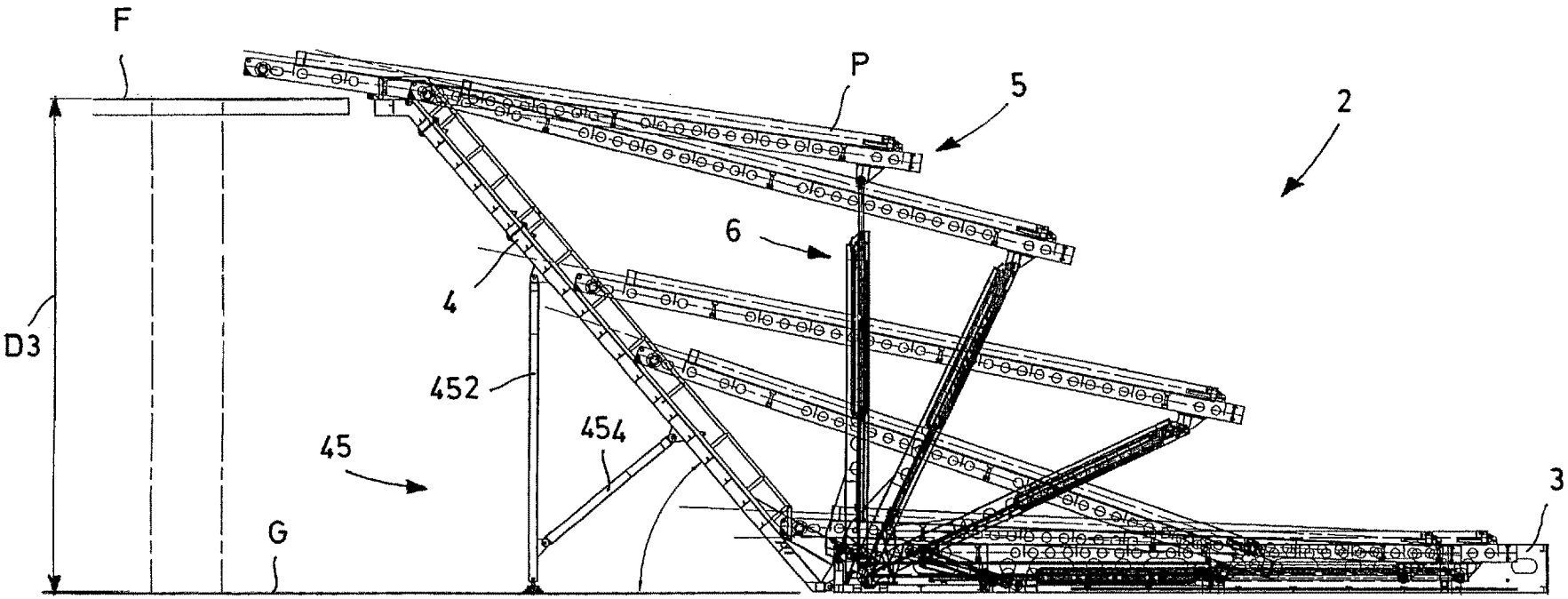

FIGS. 5A-5D show the handling apparatus in different views, in different operating configurations of the apparatus; in particular, FIG. 5A shows, in a front view of the apparatus, the apparatus itself in a first intermediate operating configuration, before the lift arm starts its rotation to lift the carrier, FIG. 5B shows the same handling apparatus as FIG. 5A in a side view with a section along plane A-A;

FIG. 5C shows, in a front view of the apparatus, the apparatus itself in a lifted operating configuration, after the lift arm has ended its rotation, thus lifting the carrier, FIG. 5D shows the same handling apparatus as FIG. 5C in a side view with a section along plane A-A;

FIGS. 6A-6D show the handling apparatus in different operating configurations; in particular, FIG. 6A shows the handling apparatus in a lowered operating configuration; FIG. 6B shows the handling apparatus in a second intermediate operating configuration, in which the first end of the carrier has reached the upper end of the ramp, in the area of the drill floor; FIG. 6C shows the handling apparatus in a third intermediate operating configuration, in which the first end of the carrier has already reached the upper end of the ramp, in the area of the drill floor, and the lift arm keeps rotating relative to the second intermediate operating configuration in order to reach the lifted operating configuration of the handling apparatus; FIG. 6D shows the handling apparatus in a lifted operating configuration;

FIGS. 7A-7B show, in different views, the first holding device comprised in the carrier; wherein FIG. 7A shows the holding element in a side sectional view; FIG. 7B shows the holding element in a plan sectional view from above;

FIGS. 8A-8C show possible embodiments of the ramp, which is adapted to adjust to different types of drilling rig;

in particular, FIG. 8A shows a first embodiment of the ramp; FIG. 8B shows a second embodiment with a greater length compared to the embodiment of FIG. 8A; FIG. 8C shows a third embodiment with a greater length compared to the embodiment of FIG. 8B.

With reference to the aforesaid figures, the handling apparatus is indicated, as a whole, with reference number 2.

The handling apparatus 2 is adapted to move drilling elements "P" from a ground level "G" to a drill floor "F" of a drilling rig 1 and from a drill floor "F" to a ground level "G".

For the purpose of the description contained herein, the term ground level "G" indicates the ground or the surface on which the drilling rig 1 is installed, the place where the handling apparatus 2 according to the invention is positioned, as well. Said ground level "G" is at a lower height relative to the drill floor "F" with reference to a vertical axis "Z". Said drill floor "F" can be positioned at different distances from said ground level "G".

For the purpose of this invention, the term drilling element "P" indicates, in a generic manner, both a drilling pipe and a hole coating element called "casing".

The handling apparatus 2 according to the invention comprises: a main support structure 3 comprising a first end 31 and a second end 32, said main support structure 3 being preferably positioned directly on said ground level "G"; an extendable ramp between the first end 31 of said main support structure 3 and the drill floor "F".

The handling apparatus 2 according to the invention comprises, furthermore, a carrier 5, which is adapted to transport a drilling element "P". Said carrier 5 is movable relative to the main support structure 3 associated therewith. Said carrier 5 comprises, in turn: a first end 51 adjacent to the ramp 4 and a second end 52 distant from said ramp 4.

The handling apparatus 2 according to the invention comprises a lift arm 6, which is adapted to lift and position the carrier 5 and comprises, in turn: a first end 61 and a second end 62.

Generally speaking, said carrier 5 is configured so that it cam move between: a first position or lower position, in which the carrier 5 is arranged above the main support structure 3, close to the ground level "G"; and a second position or lifted position, in which the carrier 5 is lifted at the level of the drill floor "F". For the purpose of this invention, the terms lower position and lifted position indicate the positions—relative to the main support structure 3—of the carrier 5 along said vertical axis "Z".

In the handling apparatus 2 according to this invention, said lift arm 6 is operatively arranged under the carrier 5, so as to move and support the second end 52 of the carrier 5 in the movement between the first and the second position of the carrier 5.

Said lift arm 6 is pivotally connected: at its first end 61, to the second end 52 of the carrier 5; at its second end 62, to the first end of the support structure 3, in a hyperstatic manner.

Said lift arm 6 is extendable, thus enabling the variation of its longitudinal extension. Said lift arm 6 comprises a first portion or fixed portion 6*a* and a second portion or movable portion 6*b*. Said second portion or movable portion 6*b* being movable relative to said first portion or fixed portion 6*a*. Said second portion or movable portion 6*b* is moved by means of a hydraulic piston 63.

Said lift arm 6 comprises an actuator device 7, which is adapted to cause said lift arm 6 to rotate around the axis relative to which said second end 62 of the lift arm 6 is pivotally connected to the main support structure 3.

Furthermore, the first end 51 of the carrier 5 is adapted to slide along said ramp 4.

The apparatus 2 according to the invention is very safe and reliable, besides being simple to be manufactured. This solution allows a reduction of the peak loads acting upon the lift arm 6.

In a possible embodiment of the handling apparatus 2 according to the invention, the main support structure 3 comprises a guide 30.

Said carrier 5 can slide along said guide 30. Therefore, said guide 30 is adapted to support the carrier 5 connected to the lift arm 6, the latter being adapted to move said carrier 5. Said carrier 5 is moved along said guide 30 by means of said movable portion 6*b* of the lift arm 6.

Hence, the carrier 5 is capable of moving along said main support structure 3. In particular, said carrier 5 slides between a first configuration, in which the second end 52 of the carrier 5 is in the area of the second end 32 of the main support structure 3, and a second configuration, in which the first end 51 of the carrier 5 is on the ramp 4, as it has moved past the first end 31 of the main support structure 3 and has started sliding along the ramp 4. In an explanatory—though not limiting—embodiment, said first end 51 of the carrier 5 has reached a median section, for example approximately in the middle, of the ramp 4. FIG. 5B shows, by mere way of example, said second configuration of the carrier 5.

In said first configuration of the carrier 5, the carrier 5 is adapted to receive or release a drilling element "P".

Said carrier 5 is moved, along said guide 30, by means of said movable portion 6*b* of the lift arm 6. In particular, said movable portion 6*b* moves said carrier 5 between said first configuration and said second configuration. The moving of the carrier 5 and of the movable portion 6*b* of the lift arm 6 is carried out by means of said hydraulic piston 63.

Said carrier 5 comprises, furthermore, a first holding device 53. Said first holding device 53 is adapted to hold the drilling element "P", positioned on the carrier 5, during the movement between said first position or lower position and said second position or lifted position—and vice versa—of the carrier 5 itself. The holding element 53 can be manufactured differently from what described below, though obtaining the same technical effects mentioned hereinafter. Furthermore, the first holding element 53, for example according to the embodiment described below, can be applied to other types of carrier 5 and/or to other handling apparatuses 2, different from the ones described herein.

In a possible embodiment, said first holding device 53 comprises a grasping element 531, which is adapted to act upon the drilling elements "P" so as to prevent them from moving and to keep them on the carrier 5 during the movements of the latter; a support element 532, on which an end of the drilling element "P" weighs, said end being the end of the drilling element "P" upon which said grasping element 531 acts; an operating mechanism 533, which is adapted to allow said grasping element 531 to switch from a first configuration or grasping configuration, in which it strikes against the drilling element "P", thus pressing it against said support element 532, to a second configuration or release configuration, in which it moves away from the drilling element "P" and from the support element 532, thus allowing the drilling element "P" to be moved again. Said grasping element 531 and said support element 532 are preferably constrained to one another, so as to be capable of moving between the respective operating configurations and, at the same time, sliding along said carrier 5.

Furthermore, said first holding device 53 comprises a moving mechanism 535, which is adapted to allow the grasping element 531 and the support element 532 to move along the longitudinal extension of the carrier 5, regardless of the operating configuration of the grasping element 531.

Preferably, both said operating mechanism 533 and said moving mechanism 535 are manufactured with mechanical and/or electromechanical devices, so as to allow the mechanisms to be more easily implemented, thus avoiding having to lay pipes, guide elements and/or cables etc. in order to supply said mechanisms.

In a preferred—though not limiting—embodiment, both said operating mechanism 533 and said moving mechanism 535 comprise a pulley system.

Said main support structure 3 comprises at least one storing structure 33, which is adapted to receive different types of drilling elements "P". Said storing structure 33 is adapted both to receive drilling elements "P" from a warehouse, in order to then position them, in the proper order requested by the drilling rig 1, on the carrier element 5, and to receive the drilling elements "P" arranged on the carrier 5, which need to be replaced in suitable warehouses (not shown).

In the preferred embodiment, said main support structure 3 comprises at least two storing structures 33, in particular one placed on one side of the main support structure 3, relative to the longitudinal axis of the structure 3 itself, and another storing structure 33 on the other side of the structure 3.

In the preferred—though not limiting—embodiment, each storing structure 33 comprises at least two, preferably three, resting elements 331. Said resting elements 331, at one end, are fixed to the storing structure 33 and, at the other end, comprise a base, which is adapted to rest on the ground defining the ground level "G". Each one of said resting elements 311 comprises a resting portion, on which the drilling elements "P" strike. By means of an actuator system, which is not shown herein, at least part of the resting structure is capable of changing its extension, thus causing said resting portion to incline, so as to move, in a proper manner, the drilling elements "P" resting on it.

Said resting elements 331 of the storing structure 33, in the preferred embodiment of the main support structure 3, fulfill the function of stabilizing elements, adapted to stabilize the structure on the ground or on the ground level "G", thus positioning the main support structure 3 in a leveled configuration. Said resting elements 331 can fulfill this function thanks to elements that can be elongated and adjusted.

Said carrier 5 comprises a second holding device 54 for the drilling elements "P", which is adapted to hold the drilling elements coming from said storing structure 33, when the carrier 5 is in said first configuration relative to the main support structure 3. Furthermore, said holding device 54 is adapted to make sure that only one drilling element "P" is positioned on the carrier 5.

In a possible embodiment, said second holding element 54 is a movable element selectively projecting from the surface of the carrier 5, which is adapted to hold the drilling element "P" in order to correctly position it on the carrier 5, for example when the drilling element "P" coming from the storing structure 33 must be correctly positioned on the carrier 5.

In the area of the first end 51, said carrier 5 comprises a roller system 56, which is adapted to allow the drilling element "P" to slide from and to the carrier 5, when the latter is, for example, in the second position or lifted position.

Furthermore, in the area of said first end 51 there is a rolling system 55, which is adapted to interact with a guide structure 42 comprised in the ramp 4 and allows the carrier 5 to slide along said ramp 4 during the lifting or the lowering of the carrier 5 itself.

Said rolling system 55 is, for example, a pair of preferably idle wheels or rollers. In the preferred embodiment, said rolling system 55 is a pair of idle wheels, which are adapted to slide in the guide structure 42, which is a pair of guides. Said pair of guides being arranged on the outer edges of the ramp 4, along the length of the ramp 4.

Said carrier element 5 comprises a first expulsion element 57, which is adapted to expel the drilling elements from the carrier 5.

Said expulsion element 57 is, for example, a pusher element, which is adapted to exert a pushing force upon the drilling element positioned on the carrier 5. Said expulsion element 57 can be used, for example, when the carrier 5 is arranged in its first configuration relative to the main support structure 3, so as to expel to the drilling element "P" and allow it to reach the storing structure 33.

Said ramp 4 comprises a sliding portion 41, on which the first end 51 of the carrier 5 can slide while moving towards the drill floor "F".

As the first end 51 of the carrier 5 slides along said sliding portion 41, said rolling system 55 slides in the guide structure 42.

Said ramp 4 comprises at least one roller 43, which is adapted to guide the carrier 5 when the latter has reached the area of the drill floor "F", in particular when said first end 51 projects out of the sliding portion 41 of the ramp 4 and is on the drill floor "F". Said roller 43 is an idle roller arranged at the upper end or distal end of the ramp 4, in the area of the drill floor "F", relative to the support structure 3. Therefore, the lower portion of the carrier 5 can slide on said roller 43.

In a preferred embodiment, said ramp 4 is pivotally connected to the main support structure 3, so as to allow the handling apparatus 2 to assume a compact configuration in the rig down configuration used for transportation.

In particular, when the handling apparatus 2 is disassembled from the drilling rig 1, for example in order to be moved, said ramp 4 is caused to rotate so as to be positioned above the main support structure 3, thus assuming a compact configuration. In particular, said ramp 4 is pivotally connected to said first end 31 of the main support structure 3, so as to rotate.

In an alternative embodiment, said ramp 4 is independent and self-bearing, as it can be separated from the support structure 3, or it can be fixed to the support structure 3 in a removable manner in order to constrain the two structures during the use of the handling apparatus 2.

In a possible embodiment, which is used by way of example and is not limiting, said ramp 4 comprises, furthermore, a support system 45, which is adapted to support the ramp 4. In this embodiment, the ramp 4 can be manufactured so as to be self-bearing. If you use a self-bearing ramp 4, you can avoid resting the ramp 4 against the drill floor "F", thus avoiding problems arising from the alignment between the drilling rig 1 and the handling apparatus 2.

If you use a self-bearing ramp 4, you can adjust the handling apparatus 2 to different types of drilling rig 1, for example to rigs with different heights of the drill floor "F" relative to the ground level "G".

In the preferred embodiment, said support system 45 comprises a first resting element 452, which, at a first end, is fixed to said ramp 4 and, at a second end, is adapted to be arranged on the ground level "G". Said first resting element assumes a vertical configuration. The support system 45 comprises a second resting element 454, which, at a first end, is fixed to said ramp 4 in a point between the end of the ramp 4 fixed to the main support structure 3 and the connection point of the first resting element 452. Said first resting element 452 and said second resting element 454 are elements with an elongated shape, which can be adjusted in their longitudinal extension, so as to correctly position the ramp 4 depending on the needs, for example so as to correctly position the ramp close to the drill floor "F". In particular, said support system 45 is adapted to ensure the positioning of the ramp 4 at an angle ranging from 45 to 60°, preferably approximately 50°, relative to the ground level "G".

Preferably, said support system 45 is adapted to remain connected to the ramp 4 even in the compact or transport configuration of the handling apparatus 2.

In an explanatory—though not limiting—embodiment, said ramp 4 is adapted to vary its longitudinal extension in order to adjust to the arrangement, and in particular to the height, of the drill floor "F" relative to the ground level "G". This solution allows changing the longitudinal extension of the ramp 4, making it longer or shorter, so that the handling apparatus can operate in the best possible way to arrange the drilling elements "P" in the area of the drill floor "F" and vice versa. In a first embodiment, said ramp 4 comprises a first portion and a second portion. Said first portion extends from the area of the connection to the main support structure 3 to the end used for the connection to said second portion, comprising the sliding portion of the ramp 4. The second portion corresponds to the end part of the ramp 4 comprising said guide structure 42 and said roller 43. Said second portion being separable from said first portion. Between said two portions you can interpose one or more prolongation elements, which are adapted to change the extension of the ramp 4. Said one or more prolongation elements can be fixed between the two portions of the ramp by means of removable fixing means.

In a second embodiment, said ramp 4 comprises a first portion, which is adapted to remain fixed, and a second portion, which is adapted to move relative to said first portion. Said ramp comprises moving mechanisms, which are adapted to change the longitudinal extension of the ramp 4, for example by means of telescopic means, so as to increase or reduce the longitudinal extension of said ramp 4.

Said support system 45 is capable of operating in both the embodiments of the ramp 4 described above.

Generally speaking, the possibility of changing the longitudinal extension of the ramp 4 helps make the handling apparatus 2 according to the invention highly versatile, as the handling apparatus 2 can be coupled to any type of drilling rig 1, both conventional and unconventional, known to a person skilled in the art.

Furthermore, said ramp 4 can be configured so that, in the compact or transport configuration of the handling apparatus 2, in which said ramp is arranged above the main support structure 3, the longitudinal extension of the ramp 4 does not exceed the longitudinal extension of the main support structure 3, thus reducing the total space taken up by the handling apparatus 2.

In a preferred—though not limiting—embodiment, said lift arm 6, at its second end 62, close to the first end 31 of the support structure 3, has dimensions that are greater than its dimension close to its first end 61.

This conformation allows a reinforcement of the area of the lift arm 6 upon which the actuator device 7 acts, especially of the fixed portion 6*a*, with a sturdiness and dimensions that are such as to properly resist the pushing force of the actuator device 7 and, at the same time, bear the weight of the carrier 5. Furthermore, this conformation allows implementing an actuator device 7 consisting of two pistons, which are adapted to act parallely at two ends of the longitudinal extension of the lift arm 6, close to the second end 62 of the arm 6.

Advantageously, said fixed portion 6*a* of the lift arm 6 comprises one or more resting elements 64, which are properly shaped so as to at least partly help bear the weight of the carrier 5. Preferably, said carrier elements 64 are adapted to help bear the weight of the carrier 5 when the latter is in its first position.

Said fixed portion 6*a* preferably has a shape that is such as to create a housing on the inside. Said housing is adapted to at least partly receive said movable portion 6*b*. Preferably, said housing is shaped so that, when the lift arm 6 is in a completely compact operating configuration, the longitudinal extension of the lift arm 6 corresponds to the longitudinal extension of the fixed portion 6*a*, as the movable portion 6*b* is totally housed inside the housing. Preferably, said fixed portion 6*a* comprises lightening openings, so as to allow said fixed portion to be manufactured with high-resistance materials, enabling at the same time a reduction of its total weight.

Said movable portion 6*b* is made by means of an actuator device, for example said hydraulic piston 63. Said actuator device or hydraulic piston 63 is arranged inside the fixed portion 6*a* to which it is constrained. Said hydraulic cylinder 63 has a stroke and dimensions that are such as to change the length of the lift arm 6.

The action of the hydraulic cylinder 63 of the movable portion 6*b* upon the carrier 5 and the action of the actuator device 7 upon said lift arm 6 allow the carrier 5, on which said drilling element "P" is physically positioned, to be moved to the height of the drill floor "F" in order to be then picked up and moved towards the center of the well, for example through the drilling head.

Generally speaking, said hydraulic piston 63 of the lift arm 6, which is adapted to extend the lift arm 6, comprises a barrel 631 and a rod 632.

In the preferred embodiment of the piston 63, the barrel 631 comprises, on the inside, a tubular insert and the rod 632 comprises a housing, into which said tubular insert can be inserted.

This conformation of the hydraulic piston 63 allow reducing the quantity of oil of the hydraulic system used for the extension of said piston 63 when the lift arm 6 needs to be extended, in particular in order to position the carrier 5, causing it to slide on said guide 30, in a first configuration, in which the second end 52 of the carrier 5 is in the area of the second end 32 of the main support structure 3.

Therefore, the hydraulic piston 63, for it is part of the movable portion 6*b* and is adapted to change the length of the lift arm 6, turns out to be particularly efficient and modular. As a matter of fact, even though it has fairly relevant geometric features, due to the need to face the problem of the peak load, it allows reducing the use of oil in the hydraulic circuit at least during those phases in which the movement of the lift arm, and in particular of the hydraulic piston 63, is not an essential movement for the correct operation of the handling device 2. Practically, on the inside of the barrel 631 and of the rod 632 of the piston 63 there is a fixed tubular insert, along which the barrel 632 moves, capable of reducing the section pushing on the rod 632, thus limiting the oil volume needed to move the arm 6 during the variation of its extension, though not changing the stiffness features of the hydraulic piston 63.

In a preferred embodiment of the lift arm 6, said hydraulic piston 63 is shaped so that said rod 632 has a distal end 632*a* having, in turn, a tapered development, for example having the shape of a truncated cone or a hemispherical shape. Said distal end 632*a*, shaped as mentioned above, is adapted to be coupled to a complementary portion of the barrel 631. Said conformation of the distal ends of the rod 632 and of the barrel 631 allow optimizing the distribution of the loads acting upon the rod 632. This solution prevents force from being applied to portions of the rod 632 and/or of the barrel 631 that can be subjected to damages that could jeopardize their use. This solution allows force to be unloaded and distributed on a greater surface.

In the preferred embodiment of the handling apparatus 2, said actuator device 7 comprises a pair of hydraulic pistons.

In a possible embodiment, said actuator device 7, at a first end 71, is fixed to said main support structure 3 and, at a second end 72, is fixed to said fixed portion 6*a* of the lift arm 6.

Therefore, said actuator device 7 is adapted to exert a pushing force upon the lift arm 6, applying force to a single point, without changing its location, so as to move said carrier 5 from a first position or lower position to a second position or lifted position. Similarly, said actuator device 7 exerts a holding force upon said lift arm 6, so as to accompany the movement of the carrier 5 from the second position to said first position.

In the embodiment comprising two pistons, said actuator device 7 exerts the force upon two points of the lift arm 6, which are aligned, so that the force applied to said arm 6 is symmetrical relative to the longitudinal axis of the arm 6, in order to avoid twisting or rotating moments, even of part of the handling apparatus 2.

In the preferred embodiment of the actuator device 7, said first end 71 is fixed to said main support structure 3 in an intermediate portion thereof, close to the first end 31 of the main support structure 3; whereas said second end 72 is fixed to the fixed portion 6*a* of the arm 6 in an intermediate portion thereof, close to the first end 61 of the lift arm 6.

In the preferred embodiment of the handling apparatus 2, there is provided one single lift arm 6. Therefore, the handling apparatus 2 according to the invention does not comprise further arms or support elements for moving the carrier 5; in particular, there are no structures with an articulated parallelogram.

In an explanatory—though not limiting—embodiment, the actuator device 7 is made by means of a pair of actuators, for example hydraulic cylinders, which are pivotally connected to the main support structure 3 fixed. Said actuator device 7 acts by exerting a pushing force upon the fixed portion 6*a* of the lift arm 6.

Figure 1A:
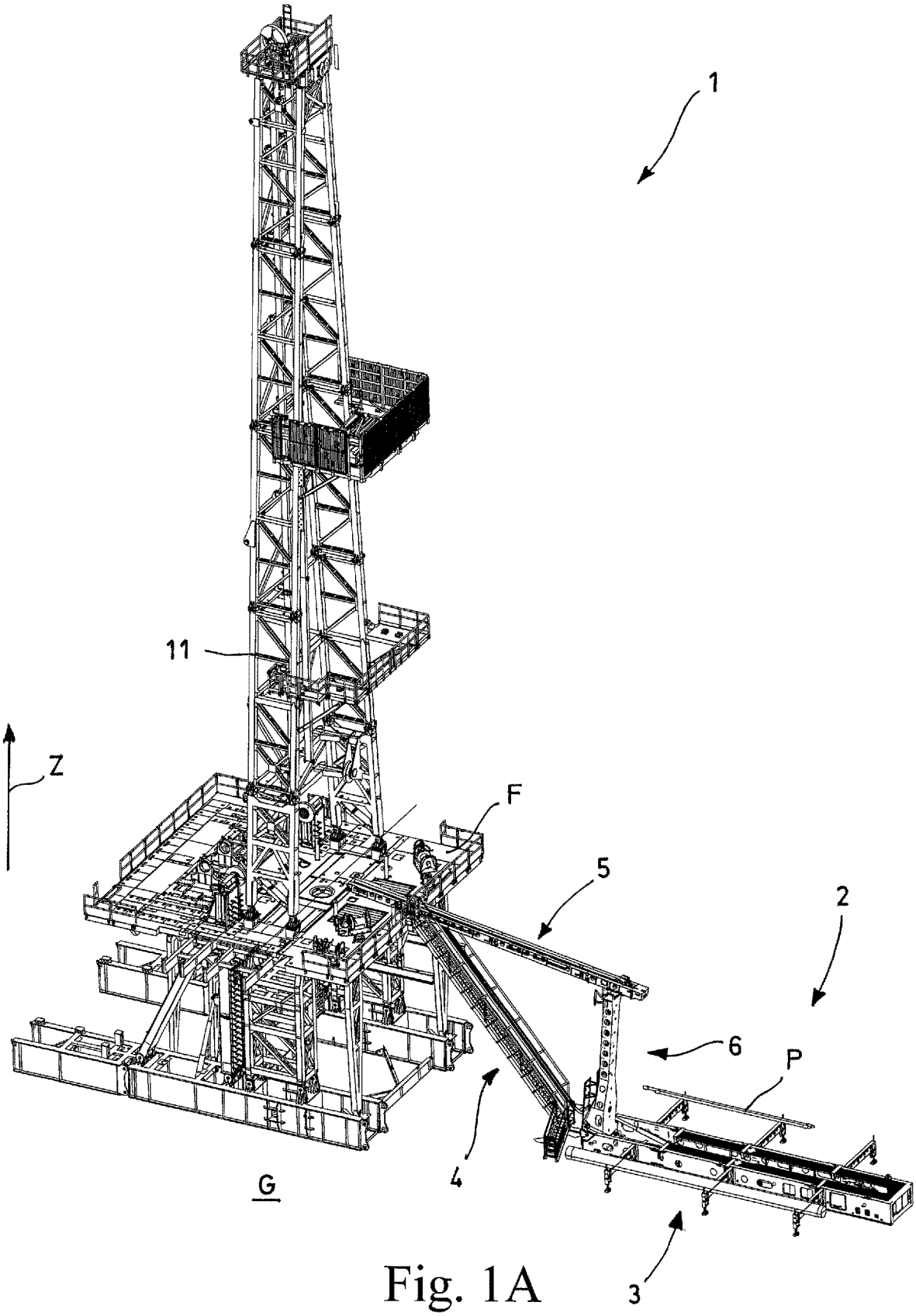

Examining more in detail how the preferred embodiment is manufactured, FIG. 1A shows the drilling rig 1 comprising the handling apparatus 2. Said drilling rig 1 comprises a drill floor "F", a mast 11 and a handling apparatus 2 according to the invention.

Figure 1B:
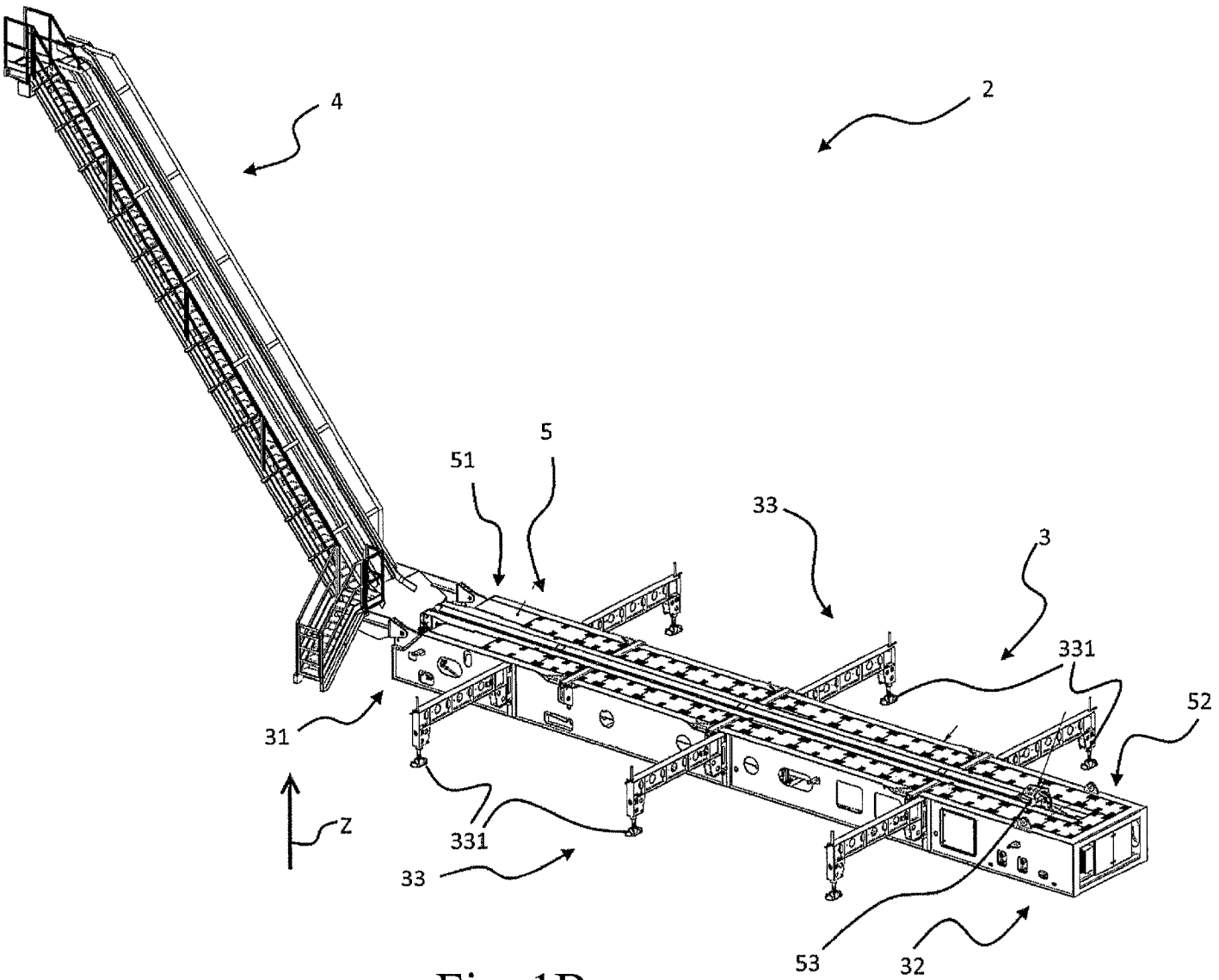

FIG. 1B shows the handling apparatus 2 according to the invention in an axonometric view independently of the drilling rig 1, so as to show more in detail the features of the handling apparatus. This figure shows the storing structures 31 for the drilling elements "P", besides the arrangement of the ramp 4 relative to the main support structure 3 and the arrangement of the carrier 5 relative to the structure 3, when the carrier is in a first position or lower position.

Figure 2A:
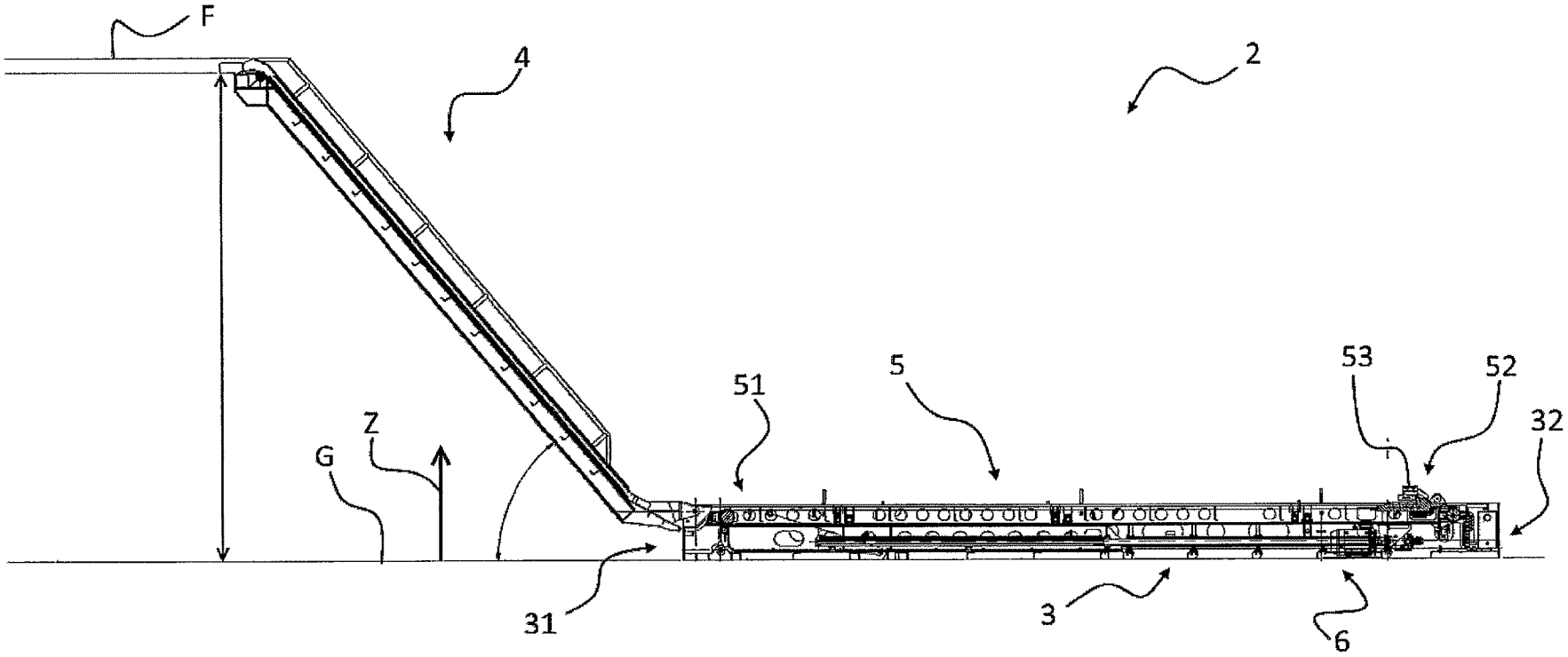
Figure 2B:
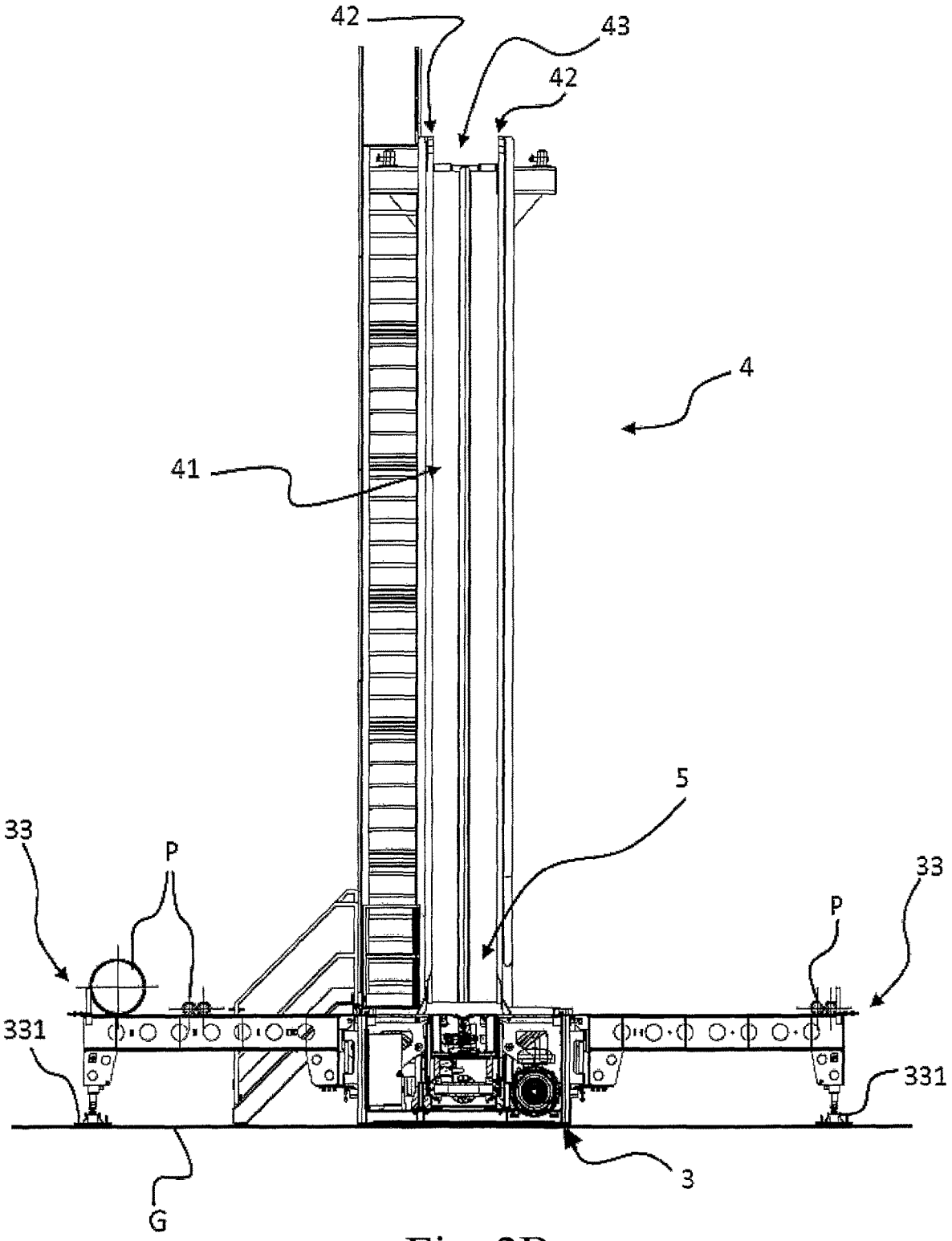
Figure 2C:
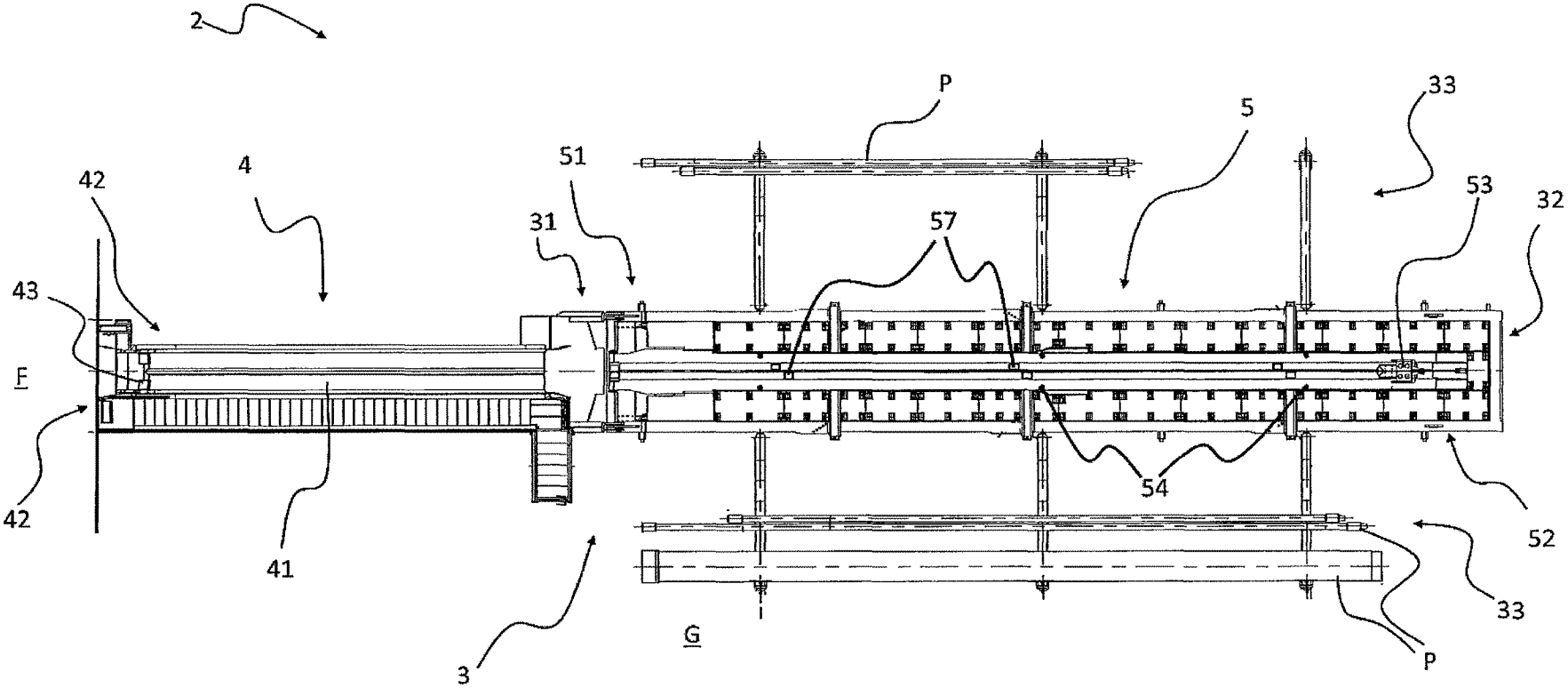

FIGS. 2A-2C show, in different views, the handling apparatus 2, in particular when said carrier 5 is in the first position or lower position. FIG. 2A, showing the apparatus in a sectional side view, allow determining the positioning of the lift arm 6 when the carrier 5 is in the first position and, more in particular, when the lift arm 6 is in the extended operating configuration and said carrier 5 is in the first configuration, in which the second end 52 of the carrier 5 is in the area of the second end 32 of the main support structure 3. From this figure you can assume that the hydraulic piston 63 is in the its extended configuration.

FIG. 2B shows the apparatus in a front view, thus allowing you to determine the positioning of the drilling elements "P" on the storing structures 33. FIG. 2C, showing the apparatus in a plan view from above, allows you to determine—from another perspective—how the drilling elements "P" can be positioned on the storing structures 33. Furthermore, this figure allows you to determine the positioning of the second holding devices 54 and of the expulsion elements 57 comprised in the carrier. In particular, the second holding devices 54 are placed along the outer edges of the carrier 5, preferably aligned along to parallel straight lines. Preferably, the second holding devices 54 placed along a straight line on one side of the carrier 5 can be operated in an independent manner relative to the ones placed on the opposite side. By so doing, depending on the direction from which the drilling elements "P" come, they can be properly held on the carrier 5, thus preventing the thrust generated by the storing structure 33 from causing the drilling element "P" to be pushed past the carrier 5, thus falling—for example—on the other support structure 33. The expulsion elements 57 are also arranged along two parallel lines extending along the length of the carrier 5. The expulsion elements 57 arranged along a first line can be activated independently of the ones arranged along the second line. By so doing, depending on which line of expulsion elements is activated, the drilling element "P" can be directed towards a storing structure 33 or towards the other one.

Figure 3A:
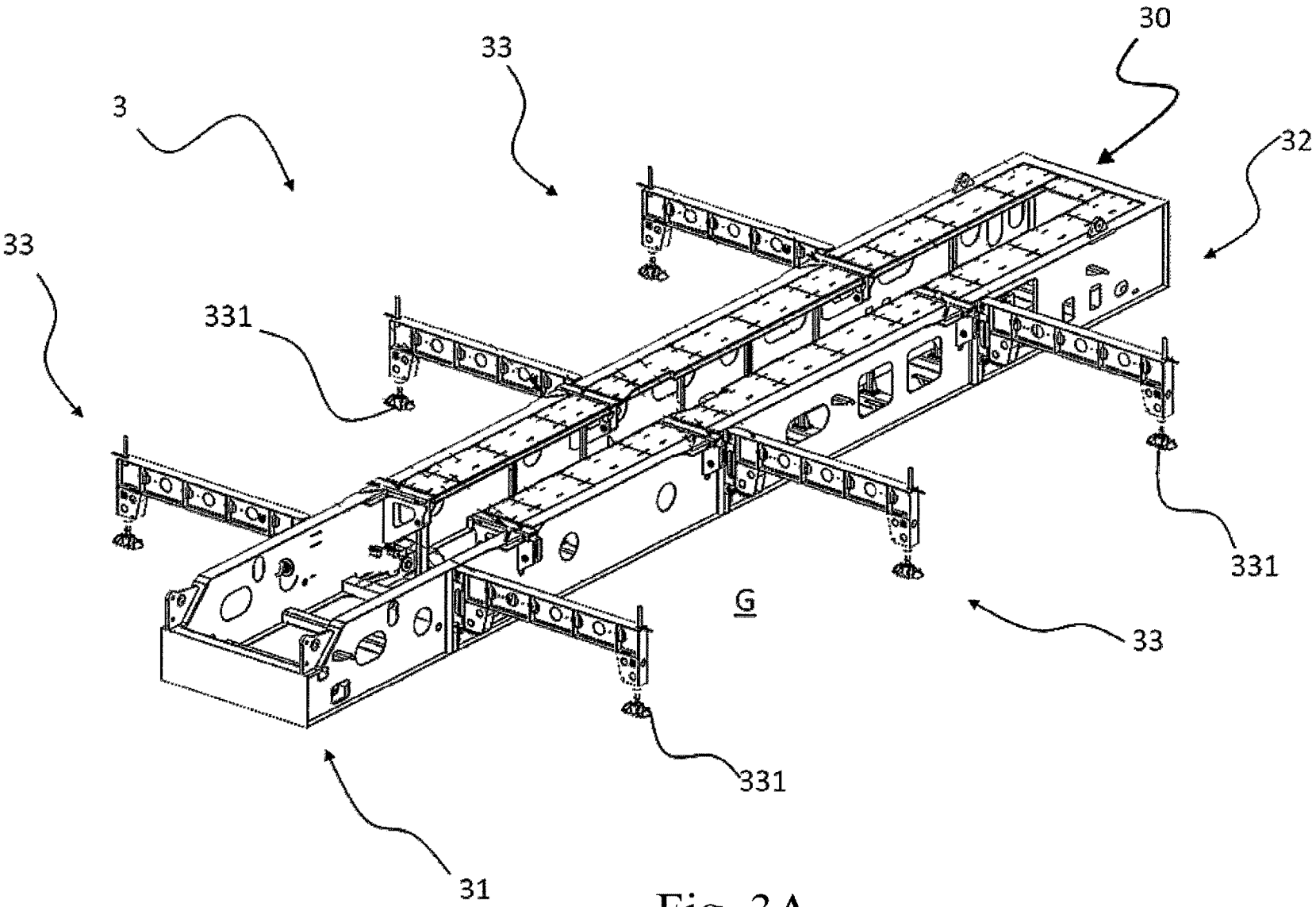
FIGS. 3A-3C show, in perspective views, different elements of the apparatus of FIG. 1B; in particular.

FIG. 3A shows the sole main support structure 3 of the handling apparatus 2 according to the invention. This figure allows understanding where the other elements of the handling apparatus are located, for example where the lift arm 6 is positioned. This figure also shows the resting elements 311 in a possible embodiment thereof as well as said guide 30. This figure allows determining the longitudinal conformation of the main support structure 3 and the manufacturing features of a possible embodiment of the storing structures 33.

Figure 3B:
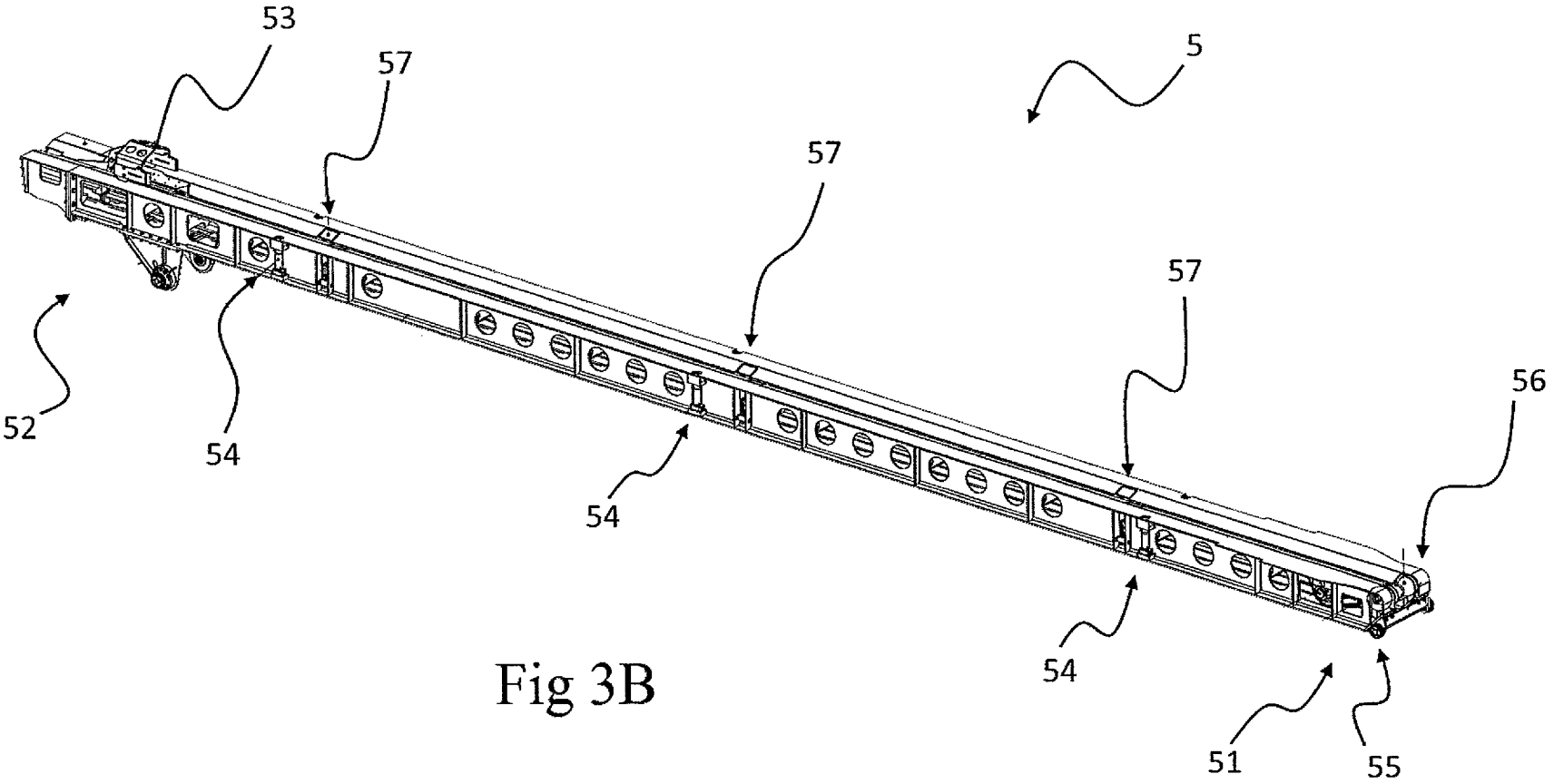

FIG. 3B shows the sole carrier 5 of the apparatus according to the invention. In FIG. 3B you can identify the different holding devices (53, 54), the rolling system 55 to allow the carrier 5 to slide along the ramp 4, and the roller system 56 to allow the drilling element "P" to move when the carrier 5 is in the second position or lifted position, close to the drill floor "F". Both the rolling system 55 and the roller system 56, as you can see in the figure, are close to the first end 51. This figure also shows the point of connection of the carrier 5 to the lift arm 6, close to the second end 52.

This figure allows determining the longitudinal conformation of the carrier 5.

Figure 3C:
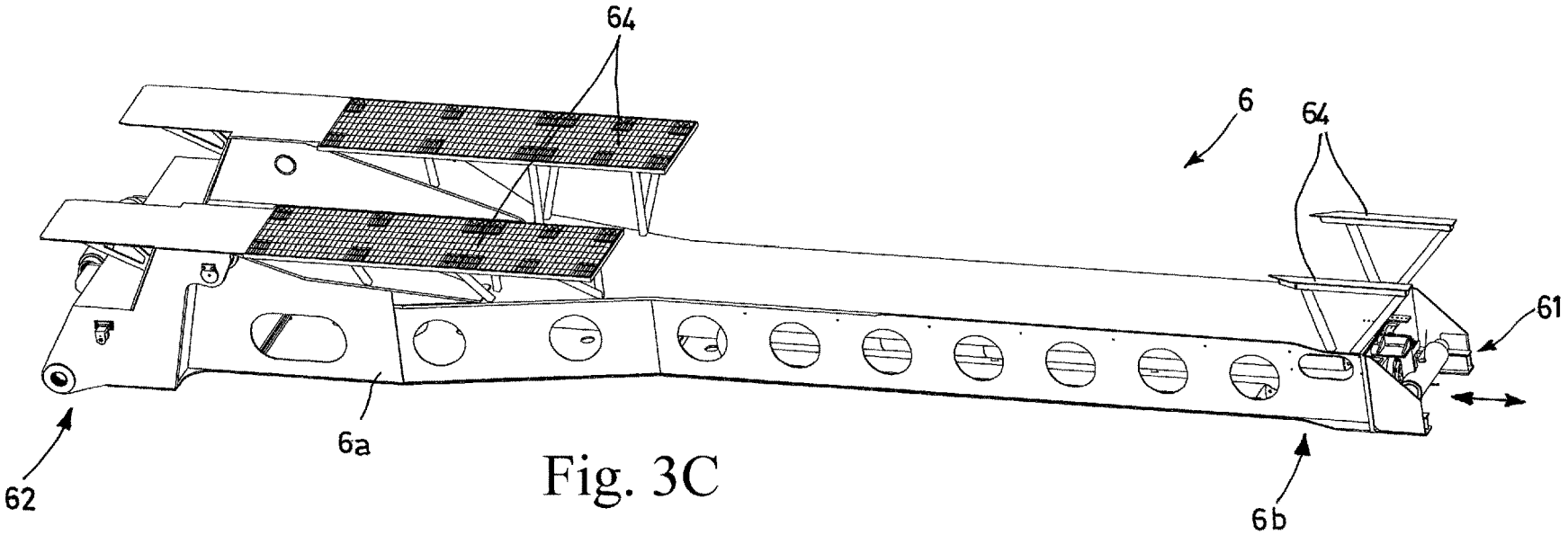

FIG. 3C shows the lift arm 6 of the handling apparatus 2 according to the invention in a compact configuration, in which the longitudinal extension of the arm 6 substantially corresponds to the longitudinal extension of the fixed portion 6*a*. This figure shows a possible embodiment of how said arm 6 can be manufactured. You can clearly identify the points in which the arm can be pivotally connected to the main support structure 3 and the points in which the actuator devices 7, not shown, can be connected to the fixed structure 6*a*, close to the second end 62. The figure also shows different embodiments of the resting elements 64 fixed to the fixed portion 6*a*.

Figure 4A:
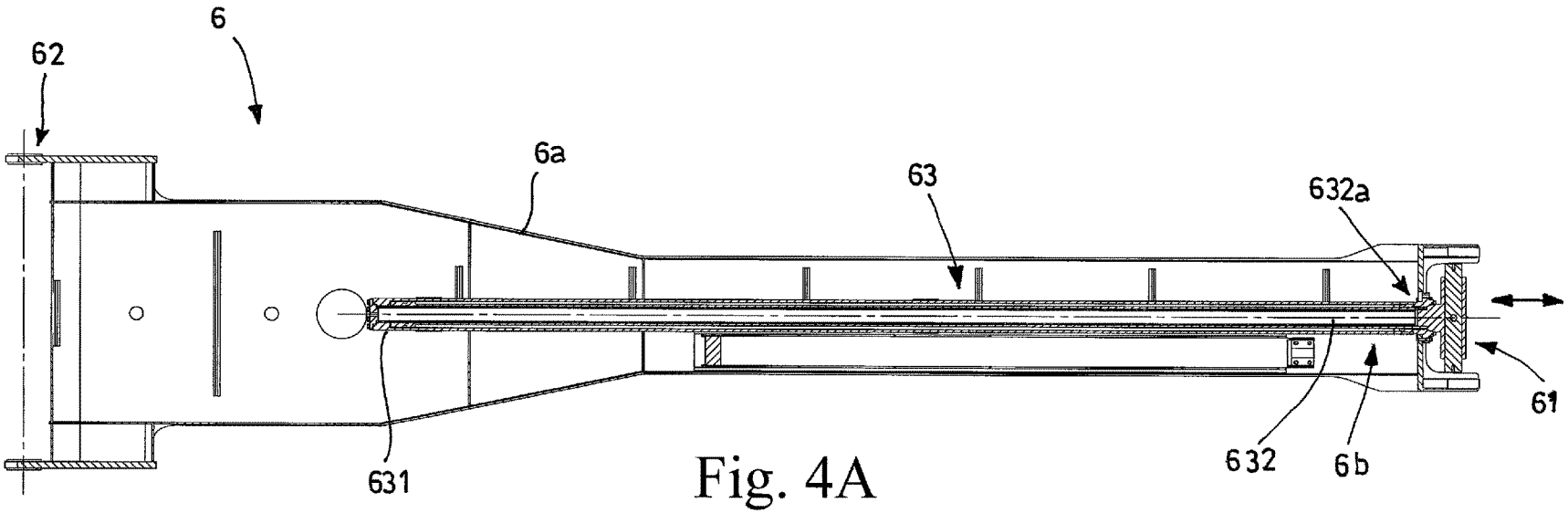
FIGS. 4A and 4B show different aspects of the lift arm; in particular.

FIG. 4A shows the lift arm 6 in a plan sectional view from above, in a compact configuration. This figure allows understanding the arrangement of the hydraulic piston 63 on the inside of the lift arm 6, and in particular of the fixed portion 6*a*. Furthermore, this figure allows determining a possible embodiment of the hydraulic piston 63 having a barrel 631 and a rod 632 according to the description above. The distal end 632*a* of the rod 632 of the piston 63, which is part of the movable portion 6*b* of the lift arm, is made according to the embodiment described above and as shown, for example, in FIG. 4B.

Figure 4B:
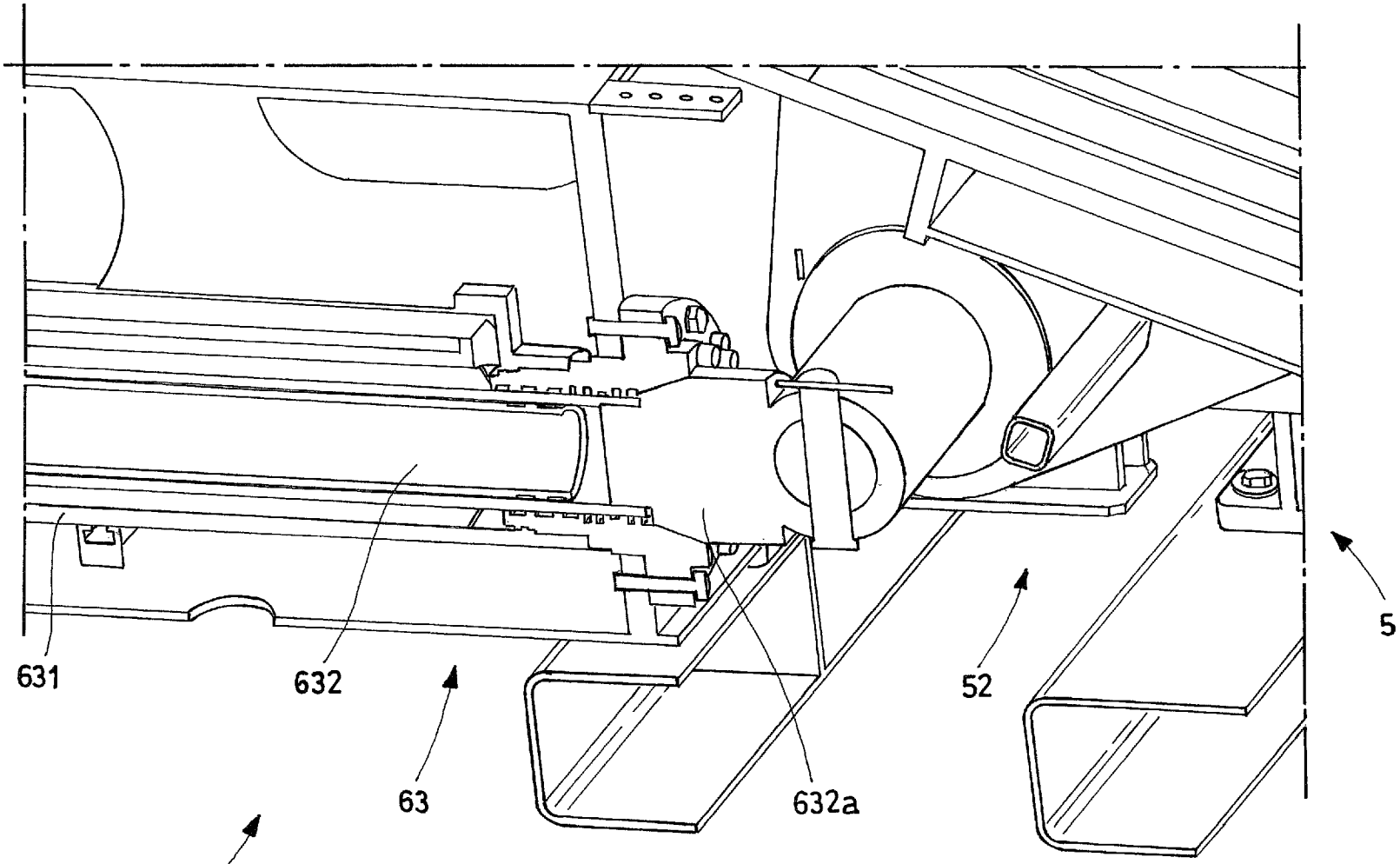

FIG. 4B shows a detail of the lift arm 6, in an operating configuration of the hydraulic piston 63, in which it is completely retracted. This figure allows determining how the distal end 632*a* of the rod 632 is shaped so as to be coupled to the end of the barrel 631 of the piston 61, so that the load acting upon the distal end 632*a* of the rod 632 is properly distributed also on the barrel 631, so as to avoid excessive loads acting upon the single point of the rod 632, loads that might damage the rod 632 itself. In the explanatory embodiment shown in the figure, the distal end 632*a* has the shape of a truncated cone, which is adapted to be coupled to a corresponding flaring on the barrel 631. In other equivalent embodiments, the distal end has a spherical or hemispherical shape, so as to be coupled to a hemispherical housing obtained at the end of the barrel.

FIGS. 5A-5D show the handling apparatus in two different views, in two different operating configurations of the apparatus. In particular, FIG. 5A shows, in a front view, the handling apparatus 2 in a first intermediate operating configuration, corresponding to a second configuration of the carrier 5, in which the second end 52 of the carrier 5 has moved past the first end 31 of the main support structure 3 and is positioned in an intermediate position of the sliding portion of the ramp 4. In this configuration, said lift arm 6 has not started its lifting movement yet, but—on the other hand—it has shortened. In this figure, the apparatus is in a condition prior to the lift arm 6 starting its rotation to lift the carrier 5.

FIG. 5B shows the same handling apparatus as FIG. 5A in a side view. In this operating configuration, you can clearly see how the carrier 5 has already started being lifted, with its first end 51, along the ramp 4. This figure also shows how the lift arm 6 has reduced its longitudinal extension.

FIG. 5C shows, in a front view, the handling apparatus 2 in a lifted operating configuration, after the lift arm 6 has performed its rotation around the axis relative to which it is pivotally connected to the main support structure 3 at its second end 62, thus lifting the carrier 5.

FIG. 5D shows the same handling apparatus as FIG. 5C in a sectional side view.

This figure shows how the first end 51 of the carrier 5 has moved past the distal end of the ramp 4 and has already reached the area of the drill floor "F". By means of the roller 43, the carrier 5 can slide past the ramp 4. The figure also shows the action of the actuator device 7 upon the lift arm 6, so as to lift the carrier 5.

In this figure you can see the lift arm 6 arranged in a substantially vertical configuration.

FIG. 6A shows the handling apparatus 2 in a first lowered operating configuration, in particular in the operating configuration in which said carrier 5 is in the first position or lower position.

FIG. 6A shows how the lift arm 6 is in an extended configuration, not completely retracted. The figure also shows how the first end 51 of the carrier 5, thanks to the moving of the lift arm 6 by means of the piston 63, has reached a position in which the first end 51 of the carrier 5 is in the area of the first end 31 of the main support structure 3. This figure allows clearly understanding how the first end 51 of the carrier 5 is ready to start sliding on the ramp 4 in the area of the sliding portion 41.

FIG. 6B shows the handling apparatus in a second intermediate operating configuration, in which the first end 51 of the carrier 5 has just reached the area of the distal end of the ramp 4, in the area of the drill floor "F". Therefore, during the moving of the carrier 5, by means of the lift arm 6, the first end 51 of the carrier 5—by sliding—has moved along the ramp 4.

FIG. 6C shows the handling apparatus 2 in a third intermediate operating configuration, in which the first end 51 of the carrier 5 has moved past the distal end of the ramp 4, in the area of the drill floor "F", and the lift arm 6 continues its rotary movement to lift the carrier 5.

FIG. 6D shows the handling apparatus 2 in a fourth intermediate operating configuration, in which a large part of the carrier 5 has moved past the distal end of the ramp 4, thus reaching the second position or lifted position of the carrier 5, corresponding to a lifted operating portion of the handling apparatus 2. In this configuration of the handling apparatus 2, the lift arm 6 has reached a substantially vertical configuration.

FIG. 7A shows the first holding device 53 applied to a carrier 5 in a sectional side view. Generally speaking, said first holding element 53 can also be applied to other types of handling apparatuses 2, different from the one described so far, though maintaining its functional features.

This figure shows the striker element 531 comprising a striker 531*a*, which acts upon a drilling element "P". Said grasping element 531 comprises a kinematic mechanism 531*b*, which is adapted to allow the striker 531*a* to move. In particular, said kinematic mechanism 531*b* is at least adapted to move the striker 531*a* causing it to make at least a translation movement, for example a rotation-translation movement. Said kinematic mechanism 531*b* is connected to said operating mechanism 533. Said operating mechanism 533 is capable of allowing the grasping element 531 to switch from a holding configuration to a release configuration, regardless of the position of the support element 532 and of the grasping element 531 along said carrier 5. Said grasping element 531 and said support element 532 are constrained to one another, so as to be capable of sliding along said carrier 5. Said support element 532 has a slide conformation, so as to be capable of sliding along said carrier 5, and comprises a first portion, on which the drilling elements "P" can strike and weigh, and a second portion, to which said grasping element 531 is fixed. The fixing of the grasping element 531 to the support element 532 is such as to allow the grasping element 531 to move with the support element 532 along said carrier 5, but—at the same time—it is such as to allow the grasping element 531 to switch between its different operating configurations.

The figure also shows the moving mechanism 535, which is adapted to move the support element 532 of the first holding device 53 along said carrier 5 and, consequently, the grasping element 531 associated with said support element 532. Said moving mechanism 535 comprises a plurality of pulleys 535*a*, preferably two, arranged at the ends (51, 52) of the carrier 5. At least one of said pulleys is a driven pulley, for example driven by means of a motor means, so as to be capable of rotating in both rotation directions. The rotation of said driven pulley causes the movement of a cable 535*b*. To said cable 535*b* there is connected said support element 532, so as to be capable of being caused to slide, following a straight path, along said carrier 5. The other pulley, located at the opposite end of the carrier 5 relative to where the driven pulley is located, is preferably an idle pulley. Preferably, said plurality of pulleys 535*a*, making up the pulley system, is arranged on a first plane, preferably a vertical plane.

FIG. 7B shows the first holding device 53 in a sectional plan view from above, where you can see the operating mechanism 533, which comprises a plurality of pulleys 533*a* arranged at the ends (51, 52) of the carrier 5. A cable 533*b* slides on said pulleys 533*a* making up the pulley system. Preferably, the pulley system is arranged on a second plane, preferably a horizontal plane, which is perpendicular to said first plane.

The operating mechanism 533 comprises, furthermore, at least one actuator device, which is adapted to change the distance between the pulleys 533*a* of the pulley system. This variation of the distance causes the generation of a force on said cable 533*a*, which is suited to act upon the kinematic mechanism 531*b* of the grasping element 531, which, as a consequence, allows the operating configuration of the grasping element 531 to be changed, in particular by moving the striker 531*a*. This actuator device is adapted to act upon at least one pulley 533*a*, changing its position relative to said second plane. In the embodiment shown in the figure, said actuator device is a linear actuator, which is adapted to move a pulley 533*a* along a straight line lying on said second plane. Therefore, said operating mechanism 533 is independent of the moving mechanism 535, as, in any position of the support element 532 along the carrier 5, the operating element 533 will be capable of operating the grasping element 531. Furthermore, the two mechanisms (533 and 532) can be operated in an independent manner, thus being capable of being operated at the same time, though without one of them influencing the other one.

In the embodiment shown in the figure, said grasping element 531—and, in particular, the kinematic mechanism 531*b*, in the end part to which said striker 531*a* is connected—comprises lever mechanisms. Preferably, the cable 535*b* of the moving mechanism 535 is fixed to the support element 532, preferably the two ends of the cable 535*b* are respectively connected to one of the two ends, along a longitudinal axis, of the support element 532, so as to allow the first holding device 53 to be correctly moved, regardless of the sliding direction along said carrier 5. Preferably, the cable 533*b* of the operating mechanism 533 is fixed, at one end, to the support element 532 and, at the opposite end, to the kinematic mechanism 531*b*, so as to permit the correct switching of the grasping element 531, regardless of the sliding direction along said carrier 5.

FIG. 8A, which shows a first embodiment of the ramp, allows determining a possible embodiment of the support system 45. In this embodiment, the handling apparatus 2 is associated with a drilling rig 1, which comprises a drill floor "F" arranged a at first height "D1" relative to the ground level, in particular at a height of approximately 9 meters. In this embodiment, the ramp has a first longitudinal extension and, in the case shown in the figure, the distal end of the ramp exceeds the height of the drill floor "F". In this embodiment, as you can see in the figure, in order to place the carrier 5 at the level of the drill floor "F", it is sufficient to carry out a rotation of the lift arm 6 smaller than 90°, approximately equal to 70°; furthermore, the lift arm 6 is in a compact configuration.

FIG. 8B shows a second embodiment, in which the drill floor "F" is at a second height "D2", which is greater than said first height "D1", in particular approximately equal to 10 meters. In the embodiment shown in the figure, you can see a ramp 4 with a greater longitudinal extension compared to the embodiment shown in FIG. 8A.

The ramp 4 is arranged at an angle relative to the main support structure 3 that is equal to the one shown in FIG. 8A. The support system 45 is also substantially the same in the two embodiments.

In the embodiment of FIG. 8B, you can see how, in order to correctly position the carrier 5 close to the drill floor "F", the rotation of the lift arm 6 is carried out with a greater angle than the one shown in FIG. 8A, in particular the figure shows a rotation of the lift arm 6 with an angle of approximately 90°.

In this embodiment, as well, in order to place the carrier 5 in the area of the drill floor "F", there is no need to extend the lift arm 6.

FIG. 8C shows a third embodiment, in which the drill floor "F" is arranged at a third height "D3" relative to the ground level "G", said third height "D3" being greater than both said second height "D2" and said first height "D1", in particular approximately at 12 meters. In this embodiment, the longitudinal extension of the ramp 4 is greater than the one of the embodiment shown in FIG. 8B.

The ramp 4 is arranged at an angle relative to the main support structure 3 that is equal to the one shown both in FIG. 8A and in FIG. 8B. The support system 45 is also substantially the same in the three embodiments.

In the embodiment of FIG. 8C, you can see how, in order to correctly position the carrier 5 close to the drill floor "F", the rotation of the lift arm 6 is carried out with a greater angle than the one shown in FIGS. 8A and 8B, in particular the figure shows a rotation of the lift arm 6 with an angle of 90°.

In this embodiment, unlike the previous embodiments, in order to place the carrier 5 in the area of the drill floor "F", the lift arm 6 needs to be extended. The extension of the lift arm 6 takes place only when the lift arm 6 has completed the 90° rotation, thus reaching a configuration that is perpendicular to the ground level "G". The extension of the arm takes place only in this moment, so as to avoid peak loads acting upon the lift arm 6 during the rotation.

In all the embodiments shown in FIGS. 8A-8C, the ramp 4 is not in contact with the drill floor "F", so as to avoid problems linked to the alignment of the drilling rig 1 and the handling apparatus 2, thus allowing the handling apparatus 2 to be associated with any type of drilling rig 1.

The handling apparatus 2 according to the invention is adapted to carry out a method for lifting a drilling element "P" from a ground level "G" to a drill floor "F".

The method according to the present invention comprises the following phases:

- receiving, on the carrier 5, at least one drilling element "P";
- shortening a lift arm 6 by retracting a movable portion 6*b* of the arm;
- after having reached the minimum extension of the lift arm 6, activating an actuator device 7, so as to cause said lift arm 6 to rotate;
- continuing the rotation of the arm 6 until a predetermined rotation angle is reached.

The phase of receiving, on a carrier 5, at least one drilling element "P" comprises moving at least one drilling element "P", placed in the area of the storing structure 33, by means of an actuator device towards the carrier 5.

When the drilling element "P" has reached the area of the carrier 5, the carrier 5 itself operates a first holding device 53, so as to secure the drilling element "P" and prevent it from falling from the carrier 5 when the latter is moved.

In a possible embodiment, at the same time with the positioning of the drilling element "P" on the carrier 5, a second holding device 54 is activated, so as to make sure that the drilling element "P" is correctly positioned on the carrier 5. As a matter of fact, due to the thrust received from the storing structure 33, the drilling element "P" could not correctly stop in the area of the carrier 5. Preferably, said second holding device 54 is activated before the first holding device 53 and, furthermore, when the first holding device 53 is activated, the second holding device 54 is deactivated, as its function is no longer necessary.

After the positioning of the drilling element "P", the carrier 5 activates the first positioning system 53 so as to hold the drilling element "P".

The phase of shortening a lift arm 6 by retracting a movable portion 6*b* of the arm 6, comprises moving, by means of the hydraulic piston 63, the movable portion 6*a* of the arm 6, so as to move said carrier 5 towards its second operating configuration, in particular in the position in which the piston 63 is completely retracted. In this operating configuration, the first end 51 of the carrier 5 is positioned on the ramp 4, preferably in a median section of the sliding portion 41 of the ramp 4. During this phase, the carrier 5, which is moved by the lift arm 6, slides along said guide 30.

The phase of activating an actuator device 7 is preferably carried out after having reached the minimum extension of the lift arm 6. The actuator device 7 allows said lift arm 6 to rotate around an axis located close to its second end 62, so as to move the carrier 5 and cause it to reach the area of the drill floor "F". Preferably, the rotation of the arm 6 takes place around an axis corresponding to the longitudinal axis of the joining element between the main support structure 3 and the lift arm 6. Said rotation axis is perpendicular to the longitudinal extension of the lift arm 6.

The phase of continuing the rotation of the arm until a predetermined rotation angle is reached allows continuing to lift the carrier 5, so as to cause it to reach the area of the drill floor "F" and, in particular, to place the carrier 5 in its second position or lifted position.

In a preferred embodiment, said rotation angle ranges from 45° to 95°, preferably from 60° to 90°.

The angle variation can also depend, among other things, on the height of the drill floor "F" relative to the ground level "G". Therefore, the present handling apparatus 2 can be used in different types of drilling rigs 1, in which the height of the drill floor "F" relative to the ground level "G" can change. By mere way of example, a drilling rig with a first height of the drill floor will need to cause the lift arm 6 to rotate with a smaller angle compared to a second drilling rig in which the drill floor is arranged at a second height, which is greater than said first height.

In a preferred—though not limiting—embodiment, if, after having reached a rotation angle of 90°, the carrier 5 has not completely reached its second position or lifted position yet, the movable portion 6*b* of the arm 6 can be extended, for example by at least partly extending said hydraulic piston 63. The arm 6 is extended by a length that is such as to allow the carrier 5 to correctly reach the second position or lifted position at the height of the drill floor "F".

Furthermore, the same operation can be carried out to position the carrier 5 in a horizontal configuration when the carrier has already reached the drill floor "F" and is in its second position.

The handling apparatus 2 according to the invention is adapted to carry out a method for lowering a drilling element "P" from a drill floor "F" to a ground level "G".

The method for lowering a drilling element from a drill floor "F" to a ground level "G", by means of the apparatus 2 according to the invention, comprises the following phases:

- receiving, on a carrier 5, at least one drilling element "P";
- activating the actuator device 7 so as to start the rotation a lift arm 6 until a horizontal configuration of the arm 6 is reached;
- elongating the lift arm 6 by extending a movable portion 6*b* of the arm;
- continuing the extension of the movable portion 6*b* until a horizontal configuration of the carrier 5 is reached.

The phase of receiving, on a carrier, at least one drilling element "P" comprises positioning a drilling element "P" on said carrier 5, for example by means of a handler and/or a drilling head.

After the positioning, the carrier 5 activates the first holding device 53 in order to hold the drilling element "P", thus preventing the latter from falling from the carrier 5 during its movements.

Subsequently, the phase of activating the actuator device 7 is carried out. By activating the actuator device 7 the rotation of the lift arm 6 starts, which rotates until it reaches a horizontal configuration, thus allowing the carrier 5 to be moved. During this movement of the arm 6, the carrier 5 will make a movement that is the opposite of the one described above, in which the first end will slide along said sliding portion 41 of the ramp 4.

After the arm 6 has reached a horizontal configuration, the phase of elongating the lift arm 6 is carried out. In this phase, the movable portion 6B of the arm is extended by means of said hydraulic piston 63. During said phase, the carrier 5 preferably slides on said guide 30.

The phase of extending the movable portion 6*b* is carried out until a horizontal configuration of the carrier 5 is reached; preferably, the extension of the lift arm 6 takes place until the carrier 5 reaches the first operating configuration, namely when its second end 52 reaches the area of the second end 32 of the main support structure 3.

Generally speaking, said movable portion 6*b* of the lift arm 6 is moved only in particular operating configurations of the handling apparatus 2. In particular, said movable portion 6*b* is not moved in order to change the size of the lift arm 6, if the actuator device 7 is acting upon the fixed portion 6*a* of the lift arm 6 and, even less so, if the actuator device 7 is moving the lift arm 6.

Preferably, said movable portion 6*b* is exclusively moved when said actuator device 7 has completely ended the moving of said lift arm 6, i.e. when the lift arm 6 has reached an end point of its rotation and/or in a particular operating configuration of the handling apparatus. In a possible explanatory—though not limiting—embodiment, said movable portion 6*b* is exclusively moved if said lift arm 6 is arranged in a horizontal configuration or in a vertical configuration.

In another possible embodiment, in which the drill floor is arranged at a height relative to the ground level is such that the carrier 5 reaches the area of the drill floor "F" even with a rotation of the lift arm 6 that is smaller than 90°, said lift arm 6 can be extended so as to position the carrier 5 in a horizontal or inclined configuration relative to the drill floor.

Furthermore, the use of the movable portion 6*b* allows the carrier 5 to make a movement along the ramp 4 when the lift arm 6 in a horizontal position, thus simplifying the lifting of the carrier 5 by allowing the arm 6 to rotate when it has its minimum length, which reduces the effort to be made for its rotation and the lifting of the carrier 5.

The use of the movable portion 6*b* allows adjusting the handling apparatus based on the drilling rig 1 to which it is associated, in particular based on the height, relative to the ground level "G", at which the drill floor "F" is arranged. This moving can be carried out when the lift arm 6 has reached a vertical position following its rotation actuated by means of the actuator device 7.

The handling apparatus 2 is adapted to be used in classic and/or movable drilling rigs 1.

The apparatus 2 can be applied in inshore and offshore drilling rigs.

Generally speaking, a drilling rig 1 comprises a drill floor "F" and a mast 11, which is arranged on the drill floor "F". Said mast 11, in turn, comprises a drilling head or top-drive.

The drilling rig 1 comprises a handling apparatus 2 according to the invention.

The handling apparatus 2 according to the invention allows using one single element, which is capable of properly lifting the carrier 5; in particular, this leads to a complete elimination of the active contribution of the ramp 4 to the lifting of the carrier 5, thus reducing the costs, the complexity and the maintenance of the handling apparatus 2. As a matter of fact, the ramp exclusively acts as a chute used to make the moving of the carrier 5 easier.

Therefore, the handling apparatus 2 can easily and safely be adjusted to any type of drilling rig 1 by simply acting upon the lift arm 6, in particular upon its extension, and/or upon the extension of the ramp 4, so as to position the carrier 5 in the area of the drill floor "F".

NUMERICAL REFERENCES

Drilling rig 1
Mast 11
Handling apparatus 2
Main support structure 3
Guide 30
First end 31
Second end 32
Storing structure 33
Resting elements 331
Ramp 4
Sliding portion 41
Guide structure 42
Roller 43
Support system 45
First resting element 452
Second resting element 454
Carrier 5
First end 51
Second end 52
First holding device 53
Grasping element 531
Striker 531*a*
Kinematic mechanism 531*b*
Support element 532
Operating mechanism 533
Pulley system 533*a*
Cable 533*b*
Moving mechanism 535
Pulley system 535*a*
Cable 535*b*
Second holding device 54
Rolling system 55
Roller system 56
Expulsion element 57
Lift arm 6
Fixed portion 6*a*
Movable portion 6*b*
First end 61
Second end 62
Hydraulic piston 63
Barrel 631
Rod 632
Distal end 632*a*
Resting element 64
Actuator device 7
First end 71
Second end 72
Ground level G
Drill floor F
Drilling elements P
First height D1
Second height D2
Third height D3
Vertical axis Z

The invention claimed is:

1. Handling apparatus adapted to move drilling elements from a ground level to a drill floor of a drilling rig, and vice versa; said handling apparatus comprising:

a main support structure comprising a first end and a second end;

an extendable ramp between the first end of said main support structure and the drill floor;

a carrier, which is adapted to hold a drilling element, is movable relative to the main support structure to which said carrier is associated, the carrier comprising:

a first end proximate the ramp and a second end distant from said ramp;

a single lift arm, which is adapted to lift and position the carrier comprises: a first end and a second end;

said carrier is configured so that said carrier moves between: a first position, in which the carrier is arranged above the main support structure, proximate the ground level; and a second position, in which the carrier is lifted at a level of the drill floor;

said single lift arm being operatively arranged under the carrier, so as to move and support the second end of the carrier in movement from and to the second position;

wherein:

said single lift arm is pivotally connected at the first end, in an area of the second end of the carrier;

said single lift arm is pivotally connected at the second end, directly to the main support structure proximate the first end of the main support structure, in a hyperstatic manner;

said single lift arm being extendable and comprising a first fixed portion movable relative to the main support structure and a second movable portion, which is movable relative to said first portion and to the main support structure;

said single lift arm comprising an actuator device, which is adapted to cause said single lift arm to rotate around an axis relative to which said second end of the single lift arm is pivotally connected directly to the main support structure;

the first end of the carrier being adapted to slide along said ramp;

said actuator device comprising a pair of hydraulic pistons; a first end of said actuator device is fixed directly to said main support structure and a second end of said actuator device is fixed to said fixed portion of the single lift arm;

said second movable portion being moved by the hydraulic pistons;

wherein said main support structure comprises a guide, along which said carrier is slidable;

said carrier being moved along said guide by said second movable portion of the single lift arm to extend and retract said hydraulic pistons.

2. The apparatus according to claim 1, wherein said hydraulic piston comprises a barrel, which has a tubular insert on an inside of the barrel, and a rod, which has a housing into which said tubular insert can be inserted.

3. The apparatus according to claim 1, wherein said hydraulic piston comprises a barrel and a rod, said rod having a distal end having, in turn, a tapered shape, which is adapted to be coupled to a complementary portion of the barrel, so as to optimize distribution of loads acting upon the rod.

4. The apparatus according to claim 1, wherein:

said first end of the actuator device is fixed directly to said main support structure in an intermediate portion thereof, proximate the first end of the main support structure;

said second end of the actuator device is fixed to the first fixed portion in an intermediate portion thereof, proximate the first end of the single lift arm.

5. The apparatus according to claim 1, wherein said carrier comprises a first holding device, which is adapted to hold the drilling element during movement between said first position or lower position and said second position or lifted position—and vice versa—of the carrier.

6. The apparatus according to claim 5, wherein said first holding device comprises:

a grasping element, which is adapted to act upon the drilling elements so as to prevent the drilling elements from moving;

a support element, on which an end of the drilling element can weigh;

an operating mechanism, which is adapted to allow said grasping element to switch from a first configuration or grasping configuration, in which the grasping element strikes against the drilling element, thus pressing the drilling element against said support element, to a second configuration or release configuration, in which the grasping element moves away from the drilling element and from the support element;

a moving mechanism, which is adapted to allow the grasping element and the support element to move along a longitudinal extension of the carrier, regardless of the operating configuration of the grasping element.

7. A method for lifting a drilling element from a ground level to a drill floor by a handling apparatus according to claim 1;

said method comprising the following:

receiving, on a carrier, at least one drilling element;

shortening the single lift arm by retracting the second movable portion of the single lift arm moving said carrier along the guide in the main support structure;

after having reached a minimum extension of the lift arm, activating the actuator device, so as to cause said single lift arm to rotate;

continuing rotation of the single lift arm until a predetermined rotation angle is reached.

8. The method according to claim 7, wherein if, after having reached a rotation angle of 90°, the carrier has not completely reached the second position or lifted position yet, extending the second movable portion of the single lift arm by a length such as to allow the carrier to reach the second position, at the height of the drill floor.

9. A method for lowering a drilling element from a drill floor to a ground level by a handling apparatus according to claim 1;

said method comprising the following:

receiving, on a carrier, at least one drilling element;

activating the actuator device so as to start rotating the single lift arm until a horizontal configuration of the single lift arm is reached;

elongating the single lift arm by extending the second movable portion of the single lift arm moving said carrier along the guide comprised in the main support structure;

continuing the extension of the second movable portion until a horizontal configuration of the carrier is reached.

10. The method according to claim 9, wherein the phase of continuing the extension of the second movable portion of the single lift arm takes place until the carrier reaches a first configuration, in which the second end of the carrier reaches an area of the second end of the main support structure.

11. A drilling rig comprising a drill floor;

a mast; and a handling apparatus according claim 1.

12. A handling apparatus adapted to move drilling elements from a ground level to a drill floor of a drilling rig, and vice versa; said handling apparatus comprising:

a main support structure comprising a first end and a second end;

an extendable ramp between the first end of said main support structure and the drill floor;

a carrier associated with the main support structure and adapted to hold a drilling element, the carrier being movable relative to the main support structure, the carrier comprising: a first end proximate the ramp and a second end distant from said ramp;

a lift arm adapted to lift and position the carrier, the lift arm comprising a first end and a second end;

said carrier is configured to move between: a first position, in which the carrier is arranged above the main support structure, proximate the ground level; and a second position, in which the carrier is lifted at a level of the drill floor;

said lift arm being operatively arranged under the carrier, to move and support the second end of the carrier in movement to and from the second position;

wherein:

said lift arm is pivotally connected at the first end, in an area of the second end of the carrier;

said lift arm is pivotally connected at the second end, directly to the main support structure proximate the first end of the main support structure, in a hyperstatic manner;

said lift arm being extendable and comprising a first fixed portion movable relative to the main support structure and a second movable portion, which is movable relative to said first portion and to the main support structure;

said lift arm comprising an actuator device, which is adapted to cause said lift arm to rotate around an axis relative to which said second end of the lift arm is pivotally connected directly to the main support structure;

the first end of the carrier being adapted to slide along said ramp;

said actuator device comprises a hydraulic piston;

a first end of said actuator device is fixed directly to said main support structure and a second end of said actuator device is fixed to said fixed portion of the lift arm;

wherein said hydraulic piston comprises a barrel and a rod, said rod having a distal end, the distal end having a tapered shape adapted to be coupled to a complementary portion of the barrel, to optimize distribution of loads acting upon the rod.

* * * * *